US011009806B2

(12) United States Patent
Saeki et al.

(10) Patent No.: US 11,009,806 B2
(45) Date of Patent: May 18, 2021

(54) IMAGE-FORMING APPARATUS INCLUDING CAM AND CAM FOLLOWER FOR MOVING DEVELOPING ROLLER TOWARD AND AWAY FROM PHOTOSENSITIVE DRUM

(71) Applicant: BROTHER KOGYO KABUSHIKI KAISHA, Nagoya (JP)

(72) Inventors: Masahito Saeki, Nagoya (JP); Toshiyuki Sano, Iwakura (JP); Shintaro Sakaguchi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/816,994

(22) Filed: Mar. 12, 2020

(65) Prior Publication Data

US 2020/0301335 A1 Sep. 24, 2020

(30) Foreign Application Priority Data

Mar. 19, 2019 (JP) ..... JP2019-051773

(51) Int. Cl.

| | |
|---|---|
| ***G03G 15/08*** | (2006.01) |
| ***G03G 21/18*** | (2006.01) |
| ***G03G 21/16*** | (2006.01) |
| ***G03G 15/00*** | (2006.01) |
| *G03G 15/09* | (2006.01) |

(52) U.S. Cl.

CPC ..... *G03G 15/0806* (2013.01); *G03G 21/1676* (2013.01); *G03G 21/1857* (2013.01); *G03G 21/1864* (2013.01); *G03G 15/0896* (2013.01); *G03G 15/0935* (2013.01); *G03G 15/5008* (2013.01); *G03G 21/16* (2013.01)

(58) Field of Classification Search

CPC ..... G03G 15/0806; G03G 21/1864; G03G 21/1676; G03G 21/1857; G03G 21/1821; G03G 21/1825

See application file for complete search history.

(56) References Cited

U.S. PATENT DOCUMENTS

| | | | | |
|---|---|---|---|---|
| 10,678,181 | B2 * | 6/2020 | Wang | G03G 21/1619 |
| 10,859,940 | B2 * | 12/2020 | Saeki | G03G 21/1671 |
| 2020/0301350 | A1 * | 9/2020 | Sakaguchi | G03G 15/5008 |
| 2020/0333727 | A1 * | 10/2020 | Sakaguchi | G03G 21/1647 |

(Continued)

FOREIGN PATENT DOCUMENTS

JP 2012-128017 A 7/2012

*Primary Examiner* — Arlene Heredia

(74) *Attorney, Agent, or Firm* — Merchant & Gould P.C.

(57) ABSTRACT

An image-forming apparatus includes a photosensitive drum, a developing roller, a cam, a switching mechanism, a cam follower, and a controller for controlling the switching mechanism to control rotation of the cam. The cam is rotatable to move the developing roller between a contact position in contact with the photosensitive drum and a separated position in separation from the photosensitive drum. To maintain the developing roller at the contact position after being moved from the separated position, the cam is rotated to move the cam follower from a first holding surface to a second holding surface of the cam through a second guide surface, and is stopped rotating to hold the cam follower in contact with a first guide surface of the cam at a position closer to the first holding surface than to the second holding surface.

9 Claims, 24 Drawing Sheets

(56) References Cited

U.S. PATENT DOCUMENTS

| | | | | |
|---|---|---|---|---|
| 2020/0356023 | A1* | 11/2020 | Sakaguchi | G03G 15/6558 |
| 2020/0387081 | A1* | 12/2020 | Sakaguchi | G03G 15/0822 |
| 2021/0011427 | A1* | 1/2021 | Saeki | G03G 21/1857 |

* cited by examiner

IMAGE-FORMING APPARATUS INCLUDING CAM AND CAM FOLLOWER FOR MOVING DEVELOPING ROLLER TOWARD AND AWAY FROM PHOTOSENSITIVE DRUM

CROSS REFERENCE TO RELATED APPLICATION

This application claims priority from Japanese Patent Application No. 2019-051773 filed Mar. 19, 2019. The entire content of the priority application is incorporated herein by reference.

TECHNICAL FIELD

The present disclosure relates to an electrophotographic image-forming apparatus including a photosensitive drum and a developing roller.

BACKGROUND

Japanese Patent Application Publication No. 2012-128017 discloses an electrophotographic image-forming apparatus including a mechanism for moving a developing roller toward and away from a photosensitive drum to contact and separate from the photosensitive drum in accordance with a rotation of a cam.

SUMMARY

In a case where a period of contact between the developing roller and the photosensitive drum is excessively prolonged, toner may be adhered to the developing roller and the photosensitive drum, and service life of the developing roller may be shortened. Hence, prompt separation of the developing roller from the photosensitive drum is desirable.

In view of the foregoing, it is an object of the present disclosure to provide an image-forming apparatus capable of promptly separating a developing roller from a photosensitive drum.

In order to attain the above and other objects, according to one aspect, the disclosure provides an image-forming apparatus including a photosensitive drum, a developing roller, a cam, a switching mechanism, a cam follower, and a controller. The developing roller is rotatable about an axis extending in an axial direction and is movable between a contact position in contact with the photosensitive drum and a separated position away from the photosensitive drum. The cam is rotatable in a prescribed rotational direction to move the developing roller between the contact position and the separated position. The cam has a cam surface including: a first holding surface; a second holding surface; a first guide surface connecting the first holding surface to the second holding surface in the prescribed rotational direction; and a second guide surface connecting the second holding surface to the first holding surface in the prescribed rotational direction. The switching mechanism is configured to control the rotation of the cam. The cam follower is in contact with the cam surface. The cam follower is movable between an operating position for positioning the developing roller at the separated position and a standby position for positioning the developing roller at the contact position. The cam follower in contact with the first holding surface is held at the standby position, whereas the cam follower in contact with the second holding surface is held at the operating position. The first guide surface is configured to guide the cam follower to move from the first holding surface to the second holding surface in accordance with rotation of the cam in the prescribed rotational direction. The second guide surface is configured to guide the cam follower to move from the second holding surface to the first holding surface in accordance with the rotation of the cam in the prescribed rotational direction. The controller is configured to provide control to the switching mechanism to control the rotation of the cam. In a case where the developing roller is maintained at the contact position after being moved from the separated position, the controller is configured to control the switching mechanism to cause the cam: to rotate to move the cam follower from the second holding surface to the first holding surface through the second guide surface; and to stop rotating to hold the cam follower in contact with the first guide surface and at a position closer to the first holding surface than to the second holding surface in the axial direction.

According to another aspect, the disclosure provides an image-forming apparatus including a photosensitive drum, a developing roller, and a developing roller moving mechanism. The developing roller is rotatable about an axis extending in an axial direction. The developing roller is movable between a contact position in contact with the photosensitive drum and a separated position away from the photosensitive drum. The developing roller moving mechanism includes: a rotatable cam rotatable in a prescribed rotational direction about a cam axis extending in the axial direction; and a cam follower movable in the axial direction. The rotatable cam has a cam surface including: a first holding surface; a second holding surface; a first guide surface connecting the first holding surface to the second holding surface in the prescribed rotational direction; and a second guide surface connecting the second holding surface to the first holding surface in the prescribed rotational direction. The rotatable cam is configured to move the cam follower between: an operating position where the cam follower is in contact with the second holding surface and the developing roller is held at the separated position; and a standby position where the cam follower is in contact with the first holding surface and the developing roller is held at the contact position.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

An image-forming apparatus 1 according to one embodiment of the disclosure will be described with reference to the accompanying drawings. The image-forming apparatus 1 of the present embodiment is a color printer.

In the following description, directions with respect to the image-forming apparatus 1 will be referred to assuming that the image-forming apparatus 1 is disposed in an orientation in which it is intended to be used. Specifically, a left side, a right side, an upper side, and a lower side in FIG. 1 will be referred to as a front side, a rear side, an upper side, and a lower side of the image-forming apparatus 1, respectively. Further, a near side and a far side in FIG. 1 will be referred to as a right side and a left side, respectively.

<Overall Structure of Image-Forming Apparatus 1>

Figure 1:
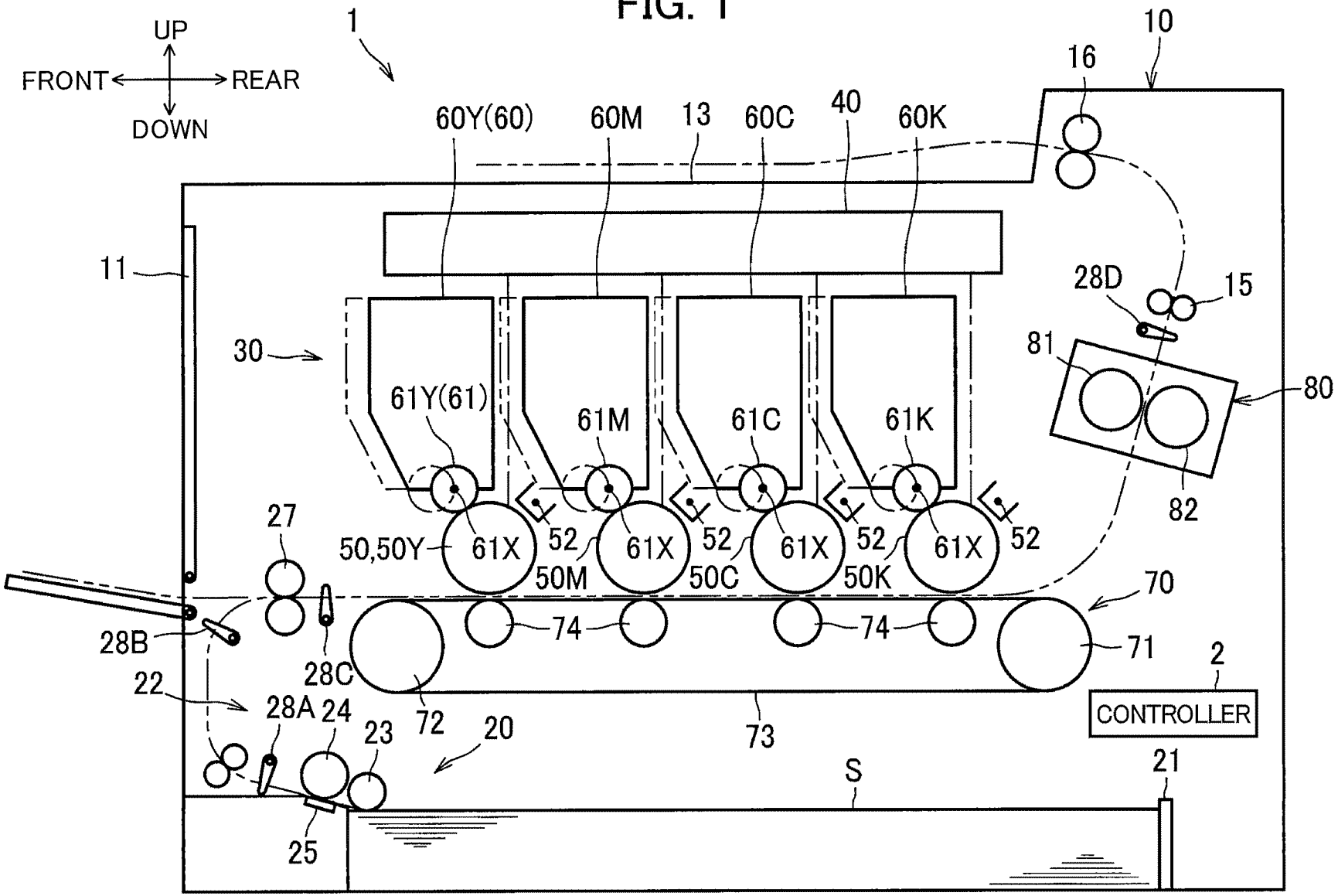
FIG. 1 is a schematic view illustrating an overall configuration of an image-forming apparatus according to an embodiment.

Referring to FIG. 1, the image-forming apparatus 1 includes a housing 10 within which a sheet feed unit 20, an image-forming unit 30, a motor 3 (FIGS. 7 and 9) as a drive source, and a controller 2 are positioned.

The housing 10 is formed with a front opening, and includes a front cover 11 for opening and closing the front opening. Further, the housing 10 has an upper surface functioning as a discharge tray 13.

The sheet feed unit 20 is positioned at a lower internal portion of the housing 10. The sheet feed unit 20 includes: a sheet tray 21 for accommodating a stack of sheets S; and a sheet feed mechanism 22 configured to supply each sheet S from the sheet tray 21 toward the image-forming unit 30. The sheet tray 21 is detachable from the housing 10 through the front opening by being pulled frontward (leftward in FIG. 1). The sheet feed mechanism 22 is positioned at a front internal portion of the housing 10. The sheet feed mechanism 22 includes a sheet feed roller 23, a separation roller 24, a separation pad 25, and a pair of registration rollers 27.

Incidentally, in the present disclosure, the sheet S is an example of an image-forming medium on which an image can be formed by the image-forming apparatus 1. For example, plain paper, an envelope, a post card, thin paper, thick paper, calendered paper, a resin sheet, and a seal are available as the sheet S.

In the sheet feed unit 20, the sheets S accommodated in the sheet tray 21 are configured to be fed by the sheet feed roller 23, and then separated one by one by the separation roller 24 and the separation pad 25. Subsequently, a position of a leading edge of each sheet S is configured to be regulated by the registration rollers 27 whose rotation is halted, and the sheet S is then configured to be supplied to the image-forming unit 30 by the rotation of the registration rollers 27. Hereinafter, a direction in which the sheet S is configured to be conveyed inside the housing 10 (depicted in a phantom line in FIG. 1) will be defined as a sheet conveying direction.

Further, a plurality of sheet sensors is provided upstream of photosensitive drums 50 (described later) in the sheet conveying direction each for detecting passage of the sheet S therethrough. Specifically, these sheet sensors include a sheet feed sensor 28A, a front sensor 28B, and a back sensor 28C.

The sheet feed sensor 28A is configured to initially detect passage of the sheet S delivered from the sheet tray 21. The sheet feed sensor 28A is positioned immediately downstream of the separation roller 24 in the sheet conveying direction. The front sensor 28B is positioned downstream of the sheet feed sensor 28A and upstream of the registration rollers 27 in the sheet conveying direction. The back sensor 28C is positioned downstream of the registration rollers 27 and upstream of the photosensitive drums 50, i.e., between the registration rollers 27 and the photosensitive drums 50 in the sheet conveying direction.

The image-forming unit 30 includes an exposure device 40, a plurality of photosensitive drums 50, a plurality of developing cartridges 60, a conveying device 70, and a fixing device 80.

The exposure device 40 includes a laser diode, a deflector, lenses, and mirrors those not illustrated. The exposure device 40 is configured to emit laser beams to expose surfaces of the respective photosensitive drums 50 and to scan the surfaces.

The photosensitive drums 50 include: a first photosensitive drum 50Y for a first color of yellow; a second photosensitive drum 50M for a second color of magenta; a third photosensitive drum 50C for a third color of cyan; and a fourth photosensitive drum 50K for a fourth color of black. Throughout the specification and drawings, in a case where colors must be specified, members or components corresponding to the colors of yellow, magenta, cyan and black are designated by adding "Y", "M", "C", "K", respectively. On the other hand, in a case where distinction of colors is unnecessary, the addition of "Y", "M", "C", "K" is omitted and naming of "first" through "fourth" is also omitted.

Four of the developing cartridges 60 are provided in one-to-one correspondence with the four photosensitive drums 50. Specifically, the developing cartridges 60 include: a first developing cartridge 60Y including a first developing roller 61Y for supplying toner of the first color (yellow) to the first photosensitive drum 50Y; a second developing cartridge 60M including a second developing roller 61M for supplying toner of the second color (magenta) to the second photosensitive drum 50M; a third developing cartridge 60C including a third developing roller 61C for supplying toner of the third color (cyan) to the third photosensitive drum 50C; and a fourth developing cartridge 60K including a fourth developing roller 61K for supplying toner of the fourth color (black) to the fourth photosensitive drum 50K.

The first developing roller 61Y, the second developing roller 61M, the third developing roller 61C, and the fourth developing roller 61K are arranged in line in this order toward downstream in the sheet conveying direction.

Each developing cartridge 60 is movable between a contact position where the developing roller 61 is in contact with the corresponding photosensitive drum 50 (indicated by a solid line in FIG. 1) and a separated position where the developing roller 61 is separated from the corresponding photosensitive drum 50 (indicated by a dashed line in FIG. 1).

Further, in a state where the second developing roller 61M, the third developing roller 61C and the fourth developing roller 61K are respectively at their separated positions, each of the second developing cartridge 60M, the third developing cartridge 60C and the fourth developing cartridge 60K is overlapped with a path of the laser beam for irradiating the photosensitive drum 50 positioned immediately upstream thereof the in the sheet conveying direction.

Specifically, the second developing cartridge 60M is overlapped with the path of the laser beam directing to the first photosensitive drum 50Y when the second developing roller 61M is at the separated position. Likewise, the third developing cartridge 60C is overlapped with the path of the laser beam directing to the second photosensitive drum 50M when the third developing roller 61C is at the separated position; and the fourth developing cartridge 60K is overlapped with the path of the laser beam directing to the third photosensitive drum 50C when the fourth developing roller 61K is at the separated position.

Figure 2:
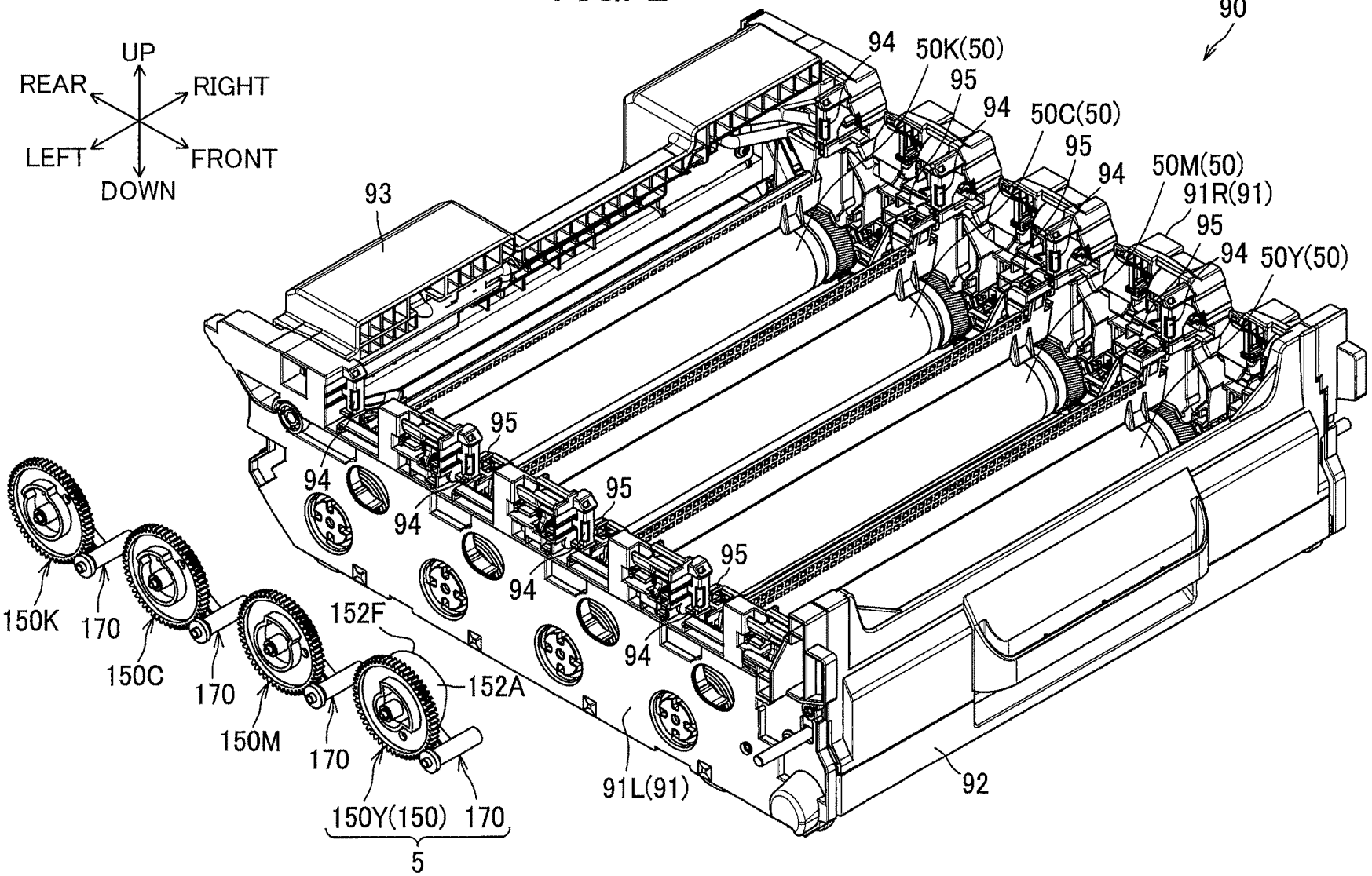
FIG. 2 is a perspective view of a support member, cams, and cam followers in the image-forming apparatus according to the embodiment.

As illustrated in FIG. 2, the photosensitive drums 50 are rotatably supported by a support member 90. Further, the support member 90 detachably supports the first developing cartridge 60Y, the second developing cartridge 60M, the third developing cartridge 60C, and the fourth developing cartridge 60K. The support member 90 is attachable to and detachable from the housing 10 through the front opening when the front cover 11 is opened. Detailed structures of the support member 90 and developing cartridges 60 will be described later.

Turning back to FIG. 1, the conveying device 70 is positioned between the sheet tray 21 and the photosensitive drums 50 in the upward/downward direction. The conveying device 70 includes a drive roller 71, a driven roller 72, an endless belt as a conveyer belt 73, and four transfer rollers 74. The conveyer belt 73 is mounted over the drive roller 71 and the driven roller 72 under tension, and has an outer peripheral surface facing each of the photosensitive drums 50. Each transfer roller 74 is positioned within a loop of the conveyer belt 73 to nip the conveyer belt 73 in cooperation with each photosensitive drum 50. The sheet S is configured to be conveyed as the conveyer belt 73 circulates while the sheet S is mounted on an upper portion of the outer peripheral surface of the conveyer belt 73, and at the same time, each toner image formed on each photosensitive drum 50 is transferred onto the sheet S, sequentially.

The fixing device 80 is positioned rearward of the photosensitive drum 50K and the conveying device 70. The fixing device 80 includes a heat roller 81 and a pressure roller 82 positioned in confrontation with the heat roller 81. A sheet discharge sensor 28D is positioned downstream of the fixing device 80 in the sheet conveying direction to detect that the sheet S moves past the sensor 28D. A pair of conveyer rollers 15 is positioned above the fixing device 80, and a pair of discharge rollers 16 is positioned above the conveyer rollers 15.

In the image-forming unit 30, a peripheral surface of each photosensitive drum 50 is uniformly charged by the corresponding charger 52, and is then exposed to light by the laser beam irradiated from the exposure device 40. Thus, an electrostatic latent image on a basis of image data is formed on the peripheral surface of each photosensitive drum 50.

Further, toner accommodated in each developing cartridge 60 is carried on a peripheral surface of each developing roller 61, and is then supplied from each developing roller 61 to the peripheral surface of each photosensitive drum 50 when the developing roller 61 comes into contact with the corresponding photosensitive drum 50. Hence, a toner image is formed on the peripheral surface of each photosensitive drum 50.

Subsequently, each toner image formed on each photosensitive drum 50 is transferred onto the sheet S while the sheet S fed onto the conveyer belt 73 moves past positions between each photosensitive drum 50 and the corresponding transfer roller 74. Then, the toner image transferred onto the sheet S is thermally fixed to the sheet S while the sheet S passes a position between the heat roller 81 and the pressure roller 82.

The sheet S discharged from the fixing device 80 is then discharged onto the discharge tray 13 by the conveyer rollers 15 and the discharge rollers 16.

<Support Member 90, Developing Cartridges 60 and Separation Mechanisms 5>

Referring to FIG. 2, the support member 90 includes: a pair of side frames 91 positioned away from each other in an axial direction of each photosensitive drum 50; a front connection frame 92 connecting front end portions of the respective side frames 91; and a rear connection frame 93 connecting rear end portions of the respective side frames 91. The pair of side frames 91 includes a right side frame 91R and a left side frame 91L. Further, chargers 52 (FIG. 1) are provided in the support member 90. Each charger 52 is positioned to face corresponding one of the photosensitive drums 50 for charging the same.

Counterpart abutment portions 94 are provided four each on respective upper portions of the side frames 91R and 91L of the support member 90. The counterpart abutment portions 94 are configured to abut slide members 64 (FIG. 3A) described later. Each counterpart abutment portion 94 is in a form of a roller rotatable about an axis extending in an upward/downward direction. Here, the upward/downward direction may be defined as a third direction which is perpendicular to a first direction (leftward/rightward direction) in parallel to the axial direction of the photosensitive drum 50 and a second direction (frontward/rearward direction) in which the photosensitive drums 50 are juxtaposed.

The support member 90 also includes a plurality of pressure members 95 two each for each of the developing cartridges 60. For each developing cartridge 60, two of the pressure members 95 are positioned one each outward of the corresponding photosensitive drum 50 in the axial direction thereof. Each of the pressure members 95 is urged rearward by a spring 95A (FIGS. 4A and 4B). In accordance with the attachment of the developing cartridge 60 to the support portion 90, each of the pressure members 95 presses against the corresponding developing cartridge 60 (specifically, a protrusion 63D of the developing cartridge 60 (FIGS. 3A through 4D) as will be described later) by an urging force of the spring 95A, to permit the corresponding developing roller 61 to be in pressure contact with the corresponding photosensitive drum 50.

The image-forming apparatus 1 further includes four separation mechanisms 5 (FIG. 2) configured to move the corresponding developing rollers 61 (first developing roller 61Y, the second developing roller 61M, the third developing roller 61C and the fourth developing roller 61K) between the contact position in contact with the corresponding photosensitive drums 50 and the separated position away from the corresponding photosensitive drums 50. Each separation mechanism 5 is provided for each of the first through fourth colors (yellow, magenta, cyan and black).

Specifically, each separation mechanism 5 includes: a cam 150 (150Y, 150M, 150C, 150K) rotatable in a predetermined rotational direction; and a cam follower 170. The cam 150 is rotatable about a rotation axis parallel to an axis 61X (FIG. 1) of the developing roller 61. The cam 150 includes a first cam portion 152A protruding rightward, i.e., inward in a direction of the rotation axis 61X of the developing roller 61 (hereinafter simply referred to as "axial direction"). The first cam portion 152A has an end face (right end face) serving as a cam surface 152F.

The cam follower 170 is movable between an operating position (illustrated in FIG. 4B) in contact with the cam surface 152F for positioning the developing roller 61 at the separated position and a standby position (illustrated in FIG. 4A) for positioning the developing roller 61 at the contact position. The cam follower 170 is configured to be slidingly moved in the axial direction (rightward) to the operating position while being in contact with the cam surface 152F to apply a pressing force to the developing cartridge 60, thereby separating the developing roller 61 from the corresponding photosensitive drum 50. While the cam follower 170 is at the standby position, the developing roller 61 is in contact with the corresponding photosensitive drum 50 and the cam follower 170 is separated from the developing cartridge 60.

Turning back to FIG. 2, each cam 150 and the cam follower 170 corresponding thereto are provided for each of the developing cartridges 60. Each pair of cam 150 and the cam follower 170 is positioned leftward of the left side frame 91L, i.e., outward of the left side frame 91L in a leftward/rightward direction. The cam 150 and the cam follower 170 will be described in detail later.

Figure 3A:
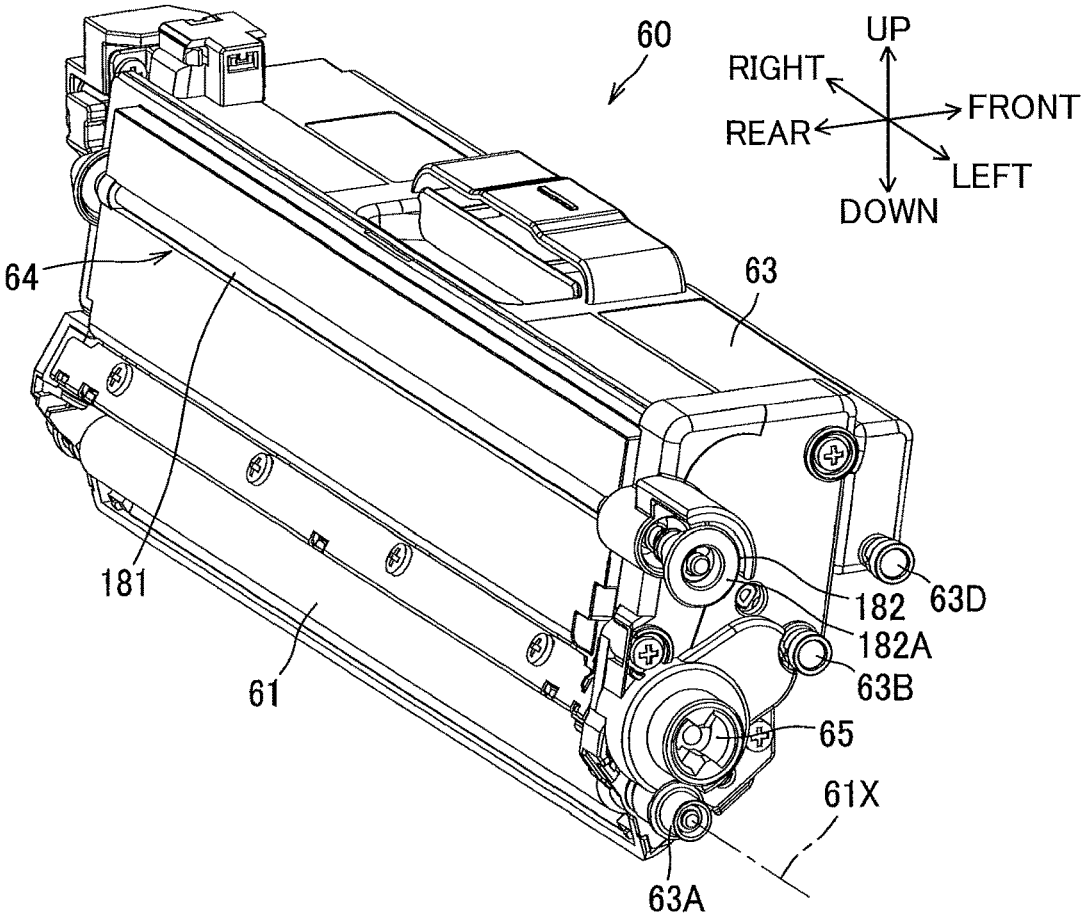
FIG. 3A is a perspective view of a developing cartridge to be accommodated in the image-forming apparatus according to the embodiment.
Figure 3B:
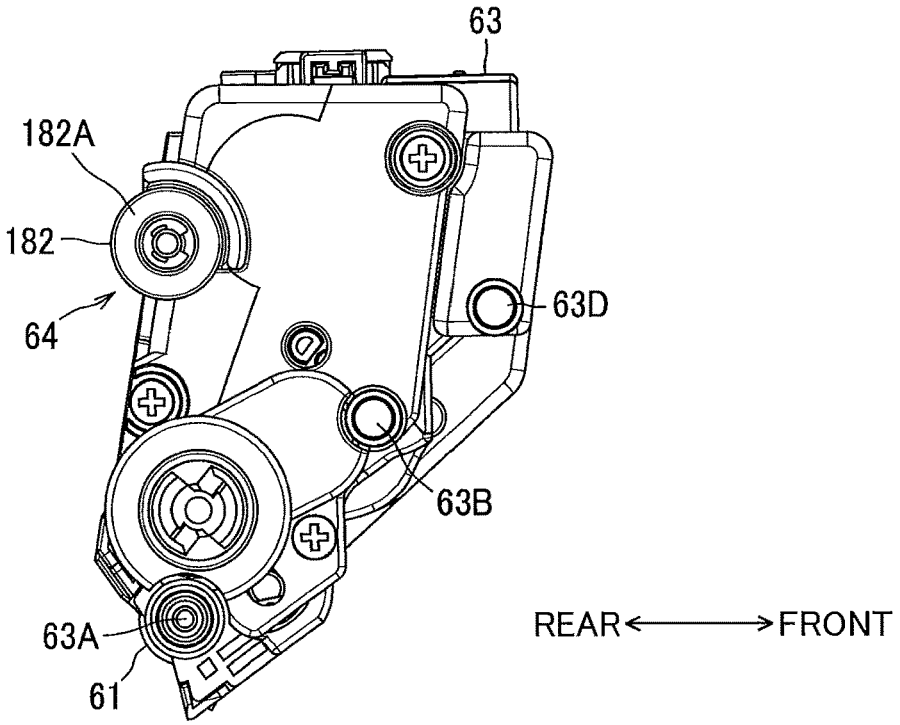
FIG. 3B is a side view of the developing cartridge of FIG. 3A.
Figure 4A:
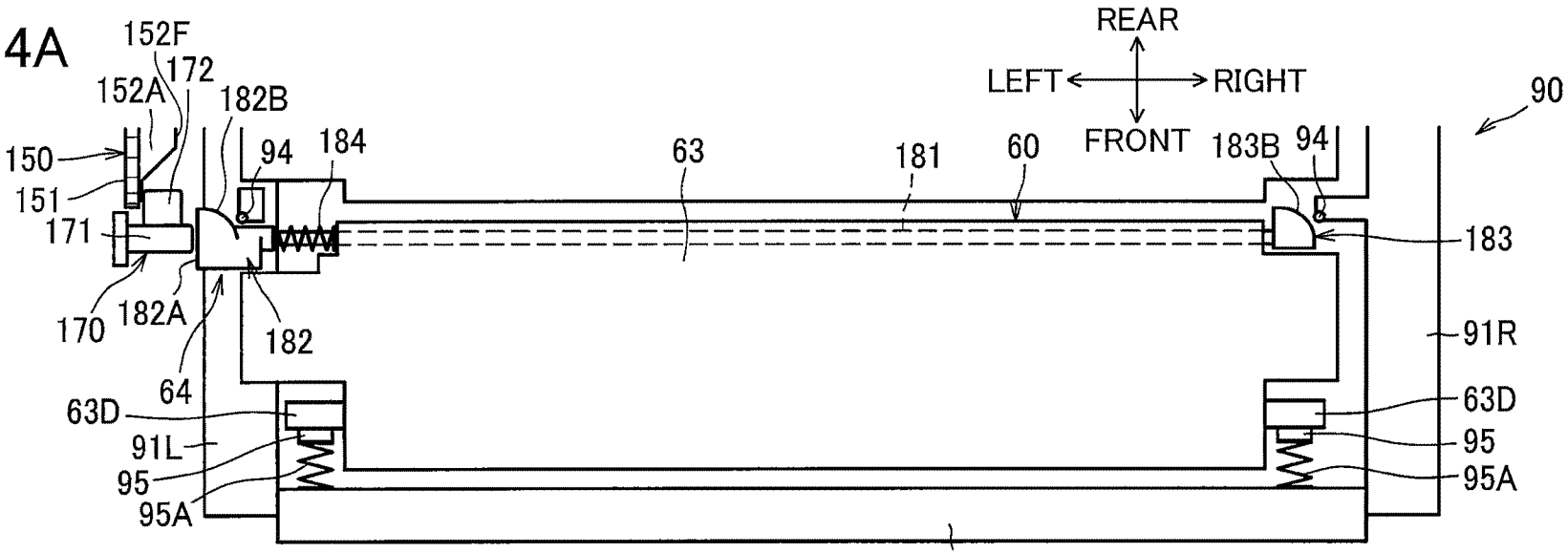
FIG. 4A is a schematic top view illustrating the developing cartridge and components in the vicinity thereof for description of a slide member of the developing cartridge, and particularly illustrating a state where the cam follower is at a standby position in the image-forming apparatus according to the embodiment.
Figure 4B:
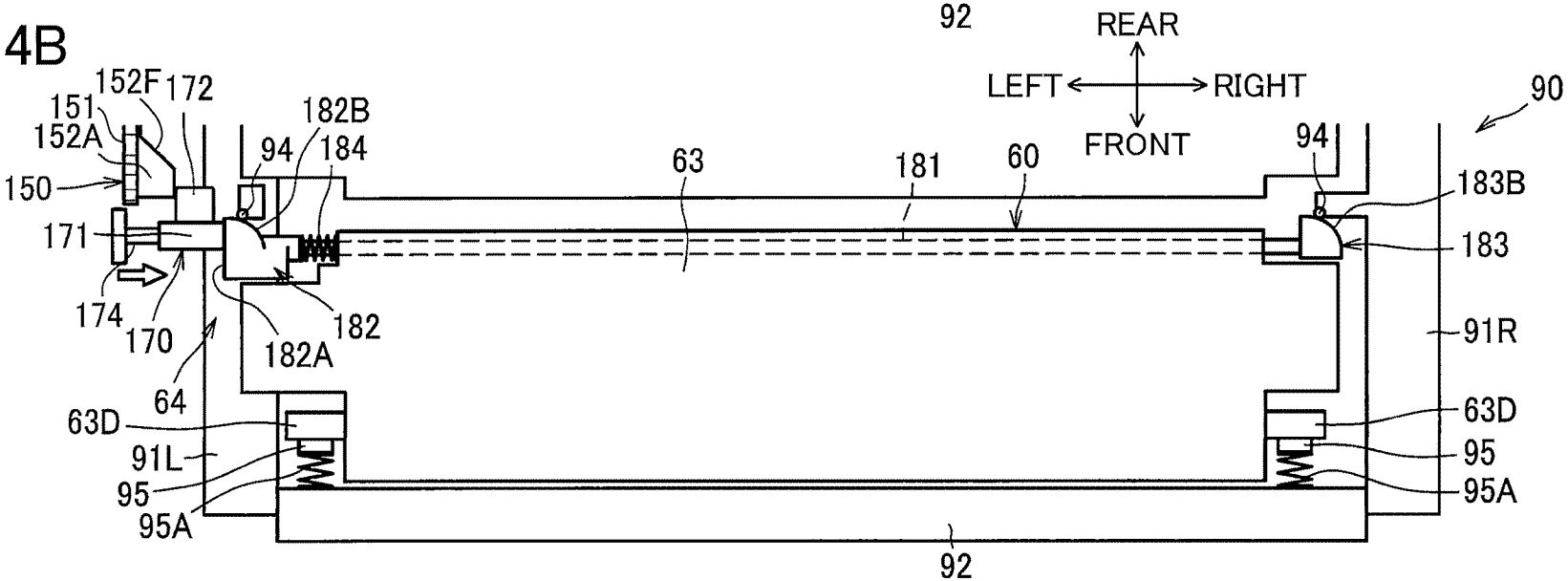
FIG. 4B is a schematic top view illustrating the developing cartridge and the components in the vicinity thereof for description of the slide member, and particularly illustrating a state where the cam follower is at an operating position in the image-forming apparatus according to the embodiment.

As illustrated in FIGS. 3A and 3B, each developing cartridge 60 (60Y, 60M, 60C, 60K) includes a casing 63, the slide member 64, and a coupling 65.

The casing 63 is configured to store toner of the corresponding color therein. The casing 63 has one side surface in the axial direction (left end surface) provided with a first protruding portion 63A and a second protruding portion 63B. The first and second protruding portions 63A and 63B protrude in the axial direction, or in the direction of the rotation axis 61X. The first protruding portion 63A is coaxial with the rotation axis 61X of the developing roller 61. The second protruding portion 63B is positioned away from the first protruding portion 63A by a predetermined distance. In the present embodiment, the second protruding portion 63B is positioned diagonally above the first protruding portion 63A. That is, the second protruding portion 63B is positioned higher than the first protruding portion 63A.

The first and second protruding portions 63A and 63B are provided as rollers rotatable about their axes extending in parallel to the axial direction of the rotation axis 61. Although not illustrated, the first and second protruding portions 63A and 63B are also provided at another side surface of the casing 63 in the axial direction (right end face) at positions symmetrical with the first and second protruding portions 63A and 63B provided at the one side surface (left end surface). Further, the above-described protrusion 63D configured to be pressed by the pressure member 95 is positioned frontward of the first and second protruding portions 63A and 63B. The protrusion 63D protrudes outward in the axial direction from each side surface of the casing 63 in the axial direction.

The coupling 65 is configured to be engaged with a coupling shaft 119 of a power transmission mechanism 100 described later. Rotational driving force is configured to be inputted to the coupling 65 from the coupling shaft 119.

The slide member 64 is slidably movable in the axial direction relative to the casing 63 upon application of the pressing force from the corresponding cam follower 170. As illustrated in FIGS. 4A and 4B, the slide member 64 includes a shaft 181, a first abutment member 182 fixed to one end (left end) of the shaft 181, and a second abutment member 183 fixed to another end (right end) of the shaft 181. The casing 63 is formed with a hole extending in the axial direction. The shaft 181 extends through the hole and is slidably supported by the casing 63.

Referring to FIGS. 3A through 4B, the first abutment member 182 has a pressure receiving surface 182A and a sloped surface 182B. The pressure receiving surface 182A is a left end face of the first abutment member 182, that is, an end face thereof in the axial direction. The sloped surface 182B extends from the pressure receiving surface 182A to be sloped with respect to the axial direction. The pressure receiving surface 182A is configured to be pressed by the corresponding cam follower 170. When the slide member 64 is pressed in the axial direction by the cam follower 170, the sloped surface 182B is configured to abut against the corresponding counterpart abutment portion 94 of the support member 90 to urge the developing cartridge 60 in a direction perpendicular to the axial direction (frontward), i.e., in a direction parallel to the sheet conveying direction, thereby moving the developing cartridge 60 to the position as illustrated in FIG. 4B. The sloped surface 182B is sloped in a curved fashion to extend gradually frontward toward the right. That is, the sloped surface 182B is sloped in a direction from the photosensitive drum 50 toward the corresponding developing roller 61 (frontward) as extending in a direction from the one end (left end) to the other end (right end) of the shaft 181 in the axial direction.

The second abutment member 183 has a sloped surface 183B similar to the sloped surface 182B of the first abutment member 182. The second sloped surface 183B is configured to abut against the counterpart abutment portion 94 of the support member 90 when the slide member 64 is pressed in the axial direction by the corresponding cam follower 170, thereby urging the developing cartridge 60 in the sheet conveying direction to move the developing cartridge 60 to the position as illustrated in FIG. 4B.

A spring 184 is interposed between the first abutment member 182 and the casing 63 to urge the slide member 64 leftward, i.e., outward in the axial direction (in a direction from the other end (right end) to the one end (left end) of the shaft 181). The spring 184 is a compression spring disposed over the shaft 181.

Figure 5:
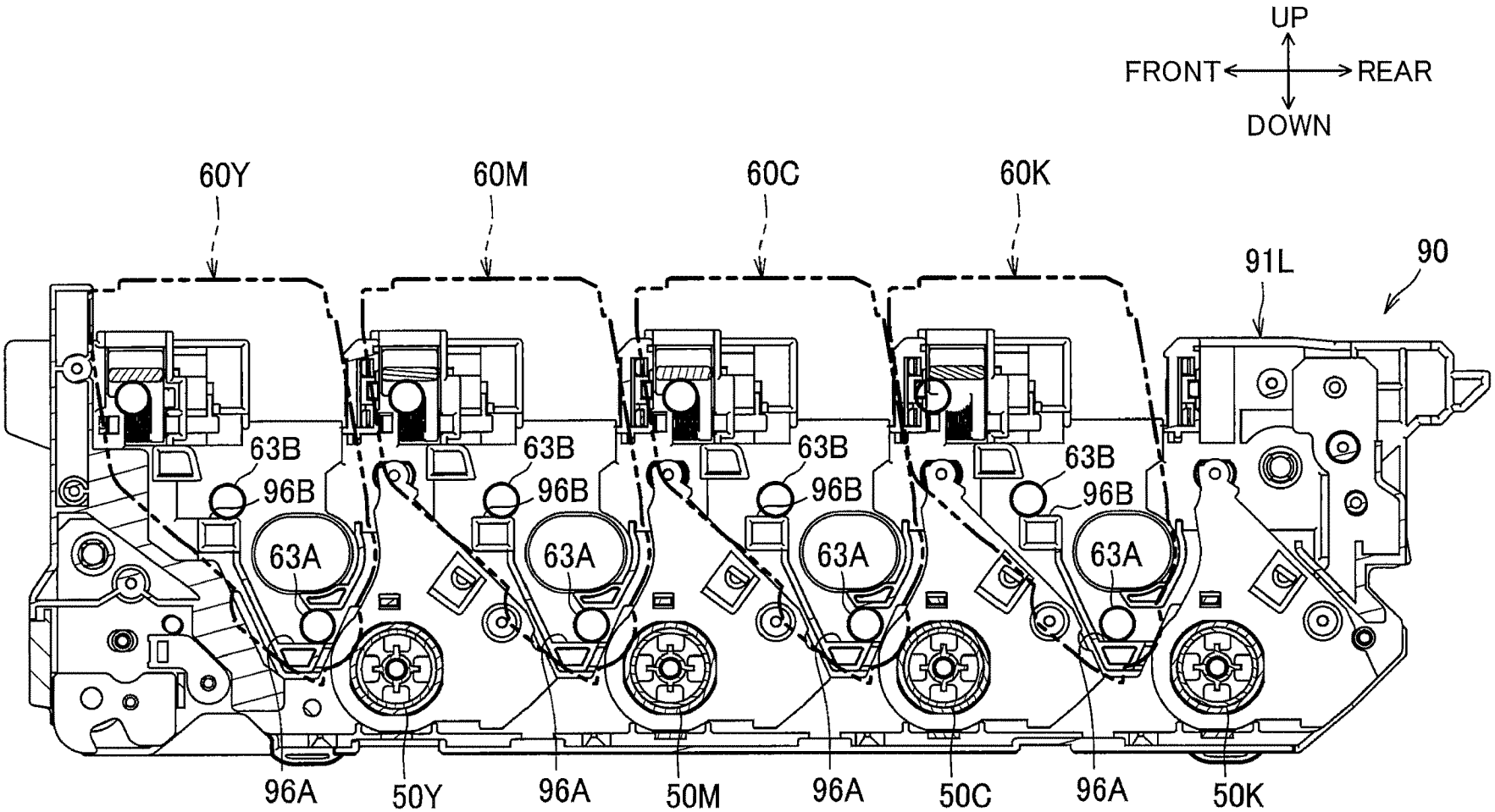
FIG. 5 is a side view of a side frame of the support member, and particularly illustrating an inner surface of the side frame to which the developing cartridge is attachable in the image-forming apparatus according to the embodiment.

As illustrated in FIG. 5, the side frame 91L of the support member 90 has an inner surface provided with a first support surface 96A and a second support surface 96B. The first support surface 96A and the second support surface 96B support the first protruding portion 63A and the second protruding portion 63B of the corresponding developing cartridge 60 from below when the developing roller 61 is moved from the contact position to the separated position. The first support surface 96A and the second support surface 96B extend in the sheet conveying direction (i.e., from the front to the rear).

The first support surface 96A is positioned to support the first protruding portion 63A. The first support surface 96A is configured to guide the developing roller 61 and to fix a position thereof in the upward/downward direction when the developing cartridge 60 is attached to the support member 90. The second support surface 96B is positioned upward of the first support surface 96A to support the second protruding portion 63B when the developing cartridge 60 is attached to the support member 90. Although not illustrated, the first and second support surfaces 96A and 96B are also provided at an inner surface of the right side frame 91R at positions symmetrical with the first and second support surfaces 96A and 96B of the left side frame 91L.

Referring to FIG. 5, when the developing roller 61 is positioned at the contact position in contact with the corresponding photosensitive drum 50, the first protruding portion 63A is positioned at a rear region of the corresponding first support surfaces 96A (see the first protruding portions 63A of the first through third developing cartridges 60Y, 60M and 60C). When the developing roller 61 is at the separated position away from the corresponding photosensitive drum 50, the first protruding portion 63A is positioned at a front region of the corresponding first support surface 96A (see the first protruding portion 63A of the fourth developing cartridge 60K).

In this way, the first through fourth developing rollers 61Y, 61M, 61C and 61K are moved rearward, i.e., in a direction opposite to the sheet conveying direction (toward upstream in the sheet conveying direction) when the separation mechanisms 5 moves the developing rollers 61Y, 61M, 61C and 61K from the contact positions to the separated positions, respectively.

Figure 11A:
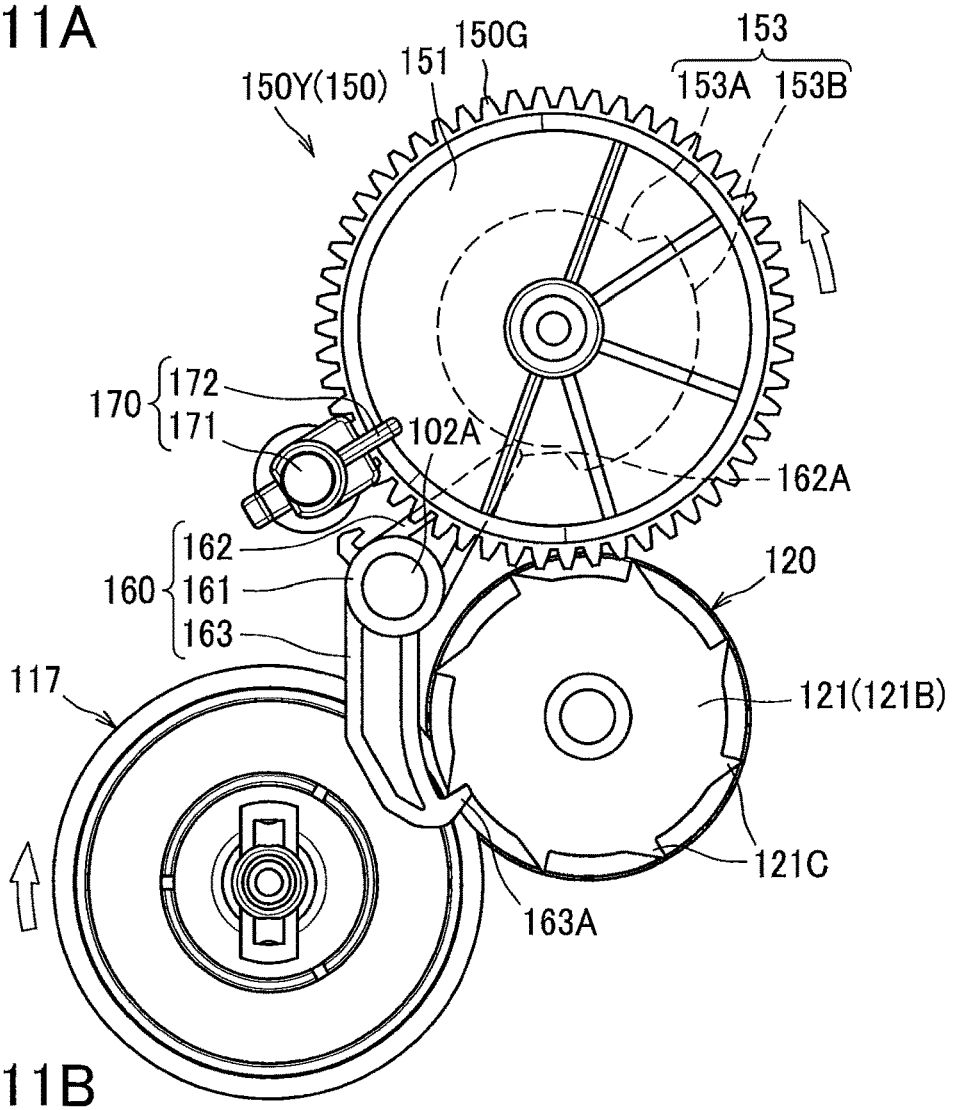
FIG. 11A is a view illustrating a separation mechanism, a lever, the clutch, and a coupling gear in a state where a developing roller is at a contact position and the clutch is at a transmission state as viewed in the axial direction in the image-forming apparatus according to the embodiment.
Figure 11B:
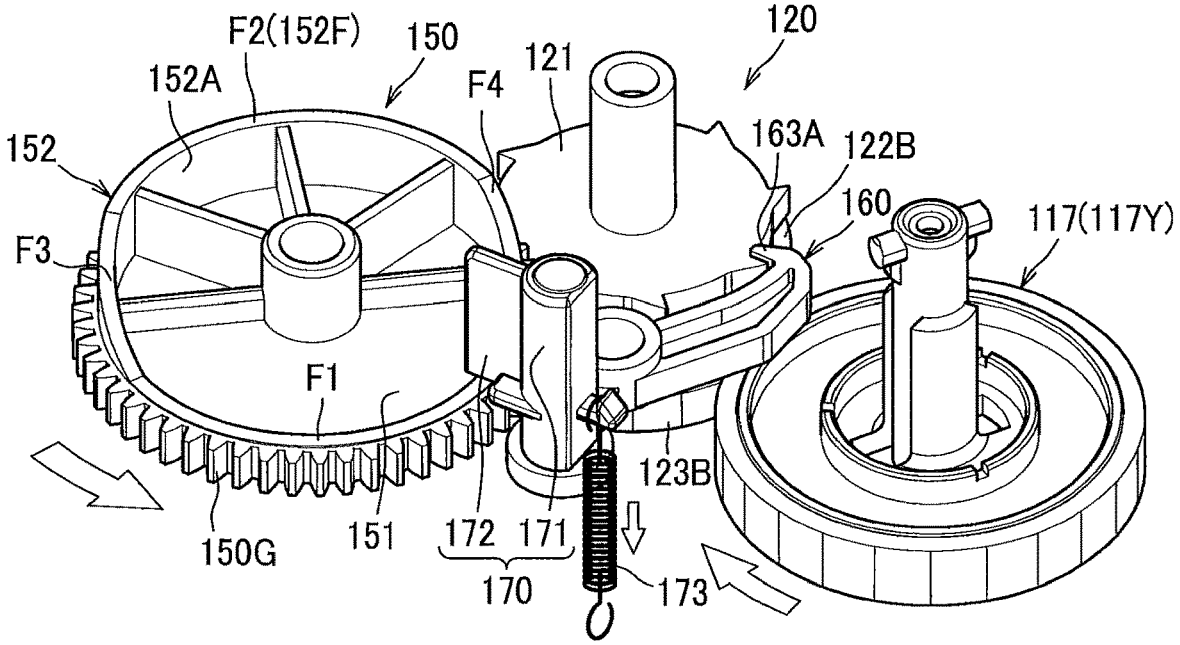
FIG. 11B is a perspective view illustrating the separation mechanism, the lever, the clutch, and the coupling gear in the state where the developing roller is at the contact position and the clutch is at the transmission state.

As illustrated in FIGS. 11A and 11B, each cam 150 includes a disc portion 151, a gear portion 150G, an end face cam 152, and a clutch control cam 153. The cam 150 is configured to move the corresponding developing roller 61 between the contact position and the separated position.

The disc portion 151 is generally circular plate shaped, and is rotatably supported by a support plate 102 (FIGS. 6-9) fixed to the housing 10 of the image-forming apparatus 1. The gear portion 150G is provided on an outer peripheral surface of the disc portion 151. The end face cam 152 constitutes one of components of the corresponding separation mechanism 5. The end face cam 152 includes the above-described first cam portion 152A protruding rightward from the disc portion 151. The end face cam 152 has the cam surface 152F which is the protruding end face (right end face) of the first cam portion 152A.

The cam surface 152F includes a first holding surface F1, a second holding surface F2, a first guide surface F3, and a second guide surface F4. In other words, the first holding surface F1, the second holding surface F2, the first guide surface F3 and the second guide surface F4 altogether constitute the cam surface 152F.

The first holding surface F1 is a flat surface configured to hold the corresponding cam follower 170 at its standby position. The second holding surface F2 is a flat surface configured to hold the corresponding cam follower 170 at its operating position. The first guide surface F3 connects the first holding surface F1 and the second holding surface F2 together and is inclined with respect to the first holding surface F1. The first guide surface F3 is configured to guide movement of the corresponding cam follower 170 from the first holding surface F1 to the second holding surface F2 in accordance with the rotation of the cam 150. The second guide surface F4 connects the second holding surface F2 and the first holding surface F1 together and is inclined with respect to the first holding surface F1. The second guide surface F4 is configured to guide movement of the corresponding cam follower 170 from the second holding surface F2 to the first holding surface F1 in accordance with the rotation of the cam 150.

The clutch control cam 153 includes a base portion 153A having a generally columnar shape, and a second cam portion 153B protruding radially outwardly from the base portion 153A. The clutch control cam 153 is integral with and coaxial with the disc portion 151, and hence, the second cam portion 153B rotates together with the cam 150. The clutch control cam 153 is configured to provide control to a clutch 120 (see FIG. 6) of the power transmission mechanism 100 to switch a power transmission status of the clutch 120 between a transmission state and a cut-off state, in cooperation with a lever 160 (FIG. 9) of the power transmission mechanism 100. Details of the power transmission mechanism 100 will be described later.

The cam follower 170 includes a slide shaft portion 171, and a contact portion 172. The slide shaft portion 171 is slidable relative to a shaft 174 (FIG. 4B) fixed the housing 10 so as to be movable in the axial direction. The slide shaft portion 171 is urged by a spring 173 (an urging member) in such a direction that the contact portion 172 is in contact with the cam surface 152F of the cam 150. Hence, the cam follower 170 is urged toward the standby position.

Specifically, the spring 173 is a tension spring having one end portion engaged with the slide shaft portion 171 and another end portion engaged with a spring attaching portion (not illustrated) provided in the housing 10. The contact portion 172 protrudes radially outward from the slide shaft portion 171 and extends in the axial direction. The contact portion 172 has one axial end face (left end face) facing the cam surface 152F and contactable with the cam surface 152F.

Figure 8:
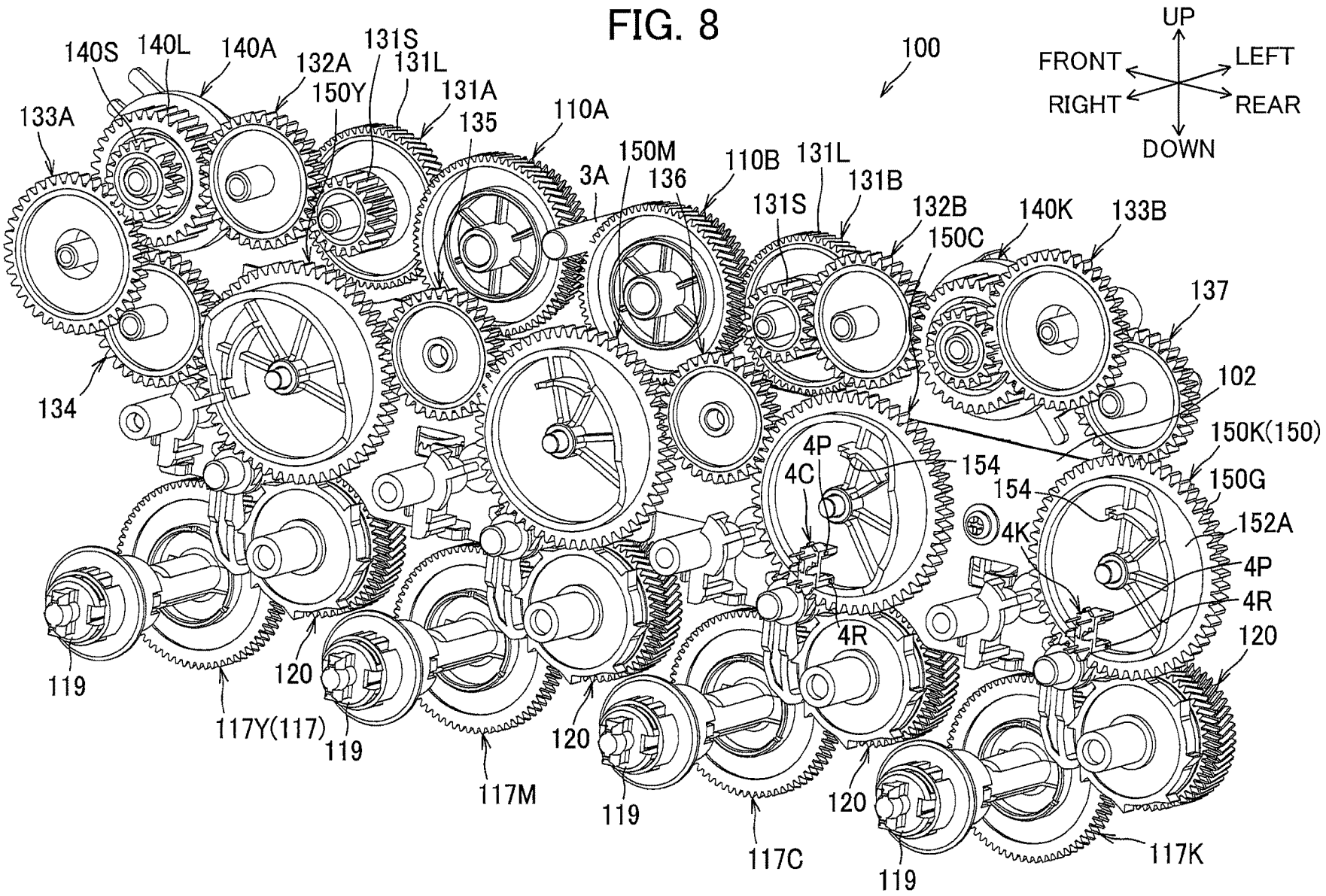
FIG. 8 is a perspective view of the power transmission mechanism as viewed from an upper right side thereof.

As illustrated in FIG. 8, the cams 150Y, 150M, 150C and 150K have generally the same configuration as one another except that a length of the first cam portion 152A of the cam 150Y in a rotational direction thereof is greater than a length of the first cam portion 152A of each of the remaining cams 150M, 150C and 150K in a rotational direction thereof.

Each of the cams 150C and 150K is further provided with a counterpart detection portion 154 protruding from each disc portion 151 in the axial direction at a position radially inward of the corresponding first cam portion 152A. Further, the housing 10 is provided with separation sensors 4C and 4K corresponding to the colors of black and cyan.

The separation sensors 4C and 4K are phase sensors or displacement sensors for detecting phases or rotational positions of the respective cams 150C and 150K. The separation sensors 4C and 4K are configured to output separation signals in response to a timing where the cams 150C and 150K are positioned within a predetermined phase range indicative of the third developing roller 61C and the fourth developing roller 61K being at the separated positions, respectively. The separation sensors 4C and 4K are configured not to output the separation signals in response to a timing where the cams 150C and 150K are positioned outside of the predetermined phase range. In the present embodiment, for simplification, output of the separation signal will be referred to as ON, and non-output of the separation signal will be referred to as OFF. A voltage level of an ON state may be higher or lower than that of an OFF state.

Each of the separation sensors 4K and 4C includes a light emitting portion 4P configured to emit detection light, and a light receiving portion 4R configured to receive the detection light. In a state where the counterpart detection portion 154 is positioned between the light emitting portion 4P and the light receiving portion 4R to block the detection light so that the light receiving portion 4R cannot receive the detection light, each separation sensor 4C, 4K is configured to output a signal indicative of being at the ON state (ON signal) to the controller 2. On the other hand, in a state where the counterpart detection portion 154 is displaced from a path of the detection light so that the light receiving portion 4R can receive the detection light, each separation sensor 4C, 4K is configured to output a signal indicative of being at the OFF state (OFF signal) to the controller 2.

Incidentally, each of the cam 150Y and 150M has a part having the same shape as the counterpart detection portion 154 of the cam 150C and 150K. However, a separation sensor corresponding to each of these parts is not provided at the housing 10, and therefore, these parts do not function as the counterpart detection portion 154 does.

Still further, as described later, the cams 150Y, 150M and 150C are configured to be rotated and stopped in mechanically interlocking relation thereamong. Accordingly, the separation sensor 4C for the color of cyan can indirectly detect phases of the cams 150Y and 150M, even though the separation sensor 4C is configured to directly detect a phase of the cam 150C.

<Mechanisms for Performing Driving/Stop and Contact/Separation of Developing Rollers 61>

Next, a structure for driving and stopping the developing rollers 61, and a structure for moving the developing rollers 61 to come into contact with and to be separated from the photosensitive drums 50 will be described in detail.

Figure 6:
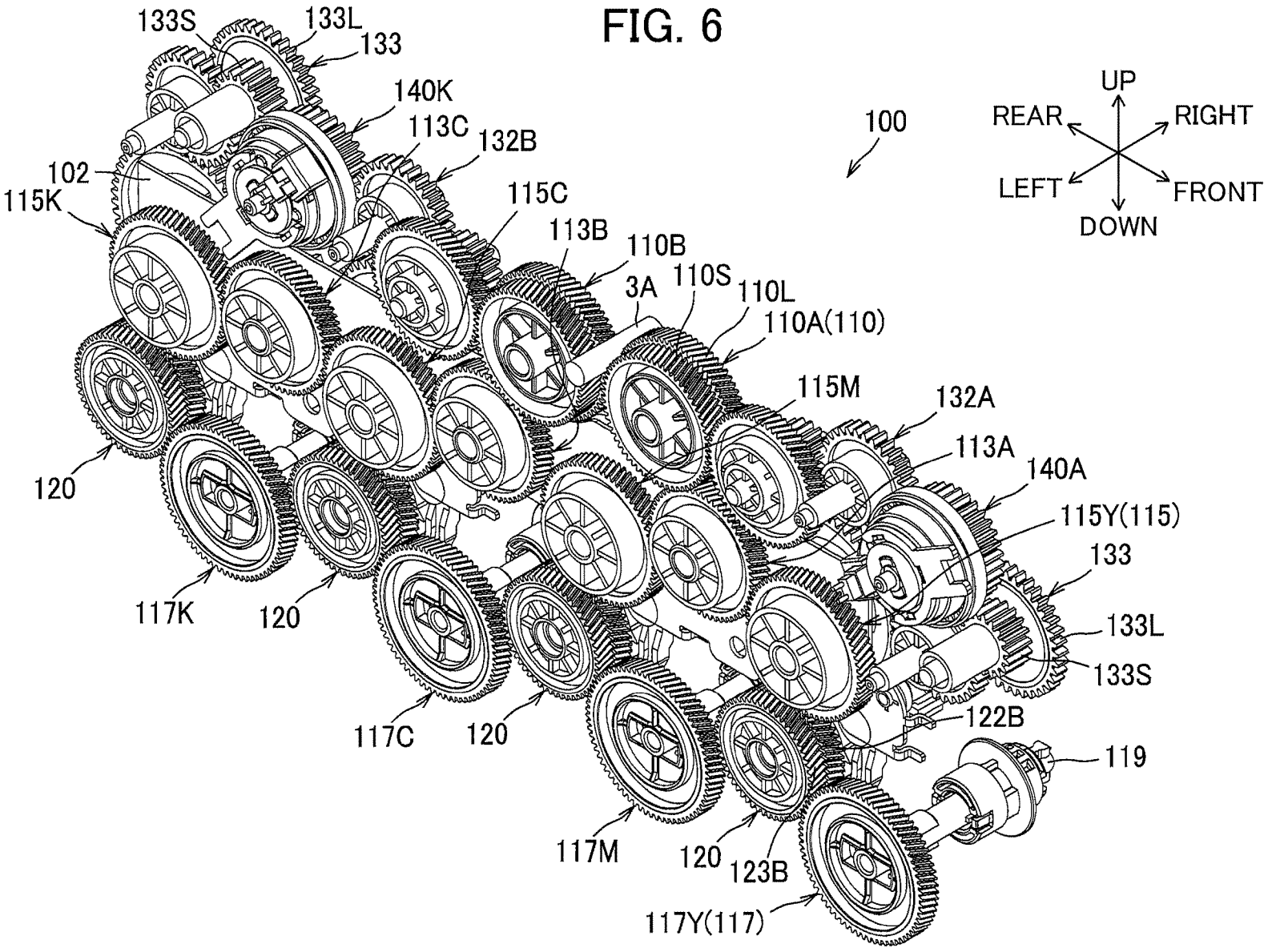
FIG. 6 is a perspective view of a power transmission mechanism as viewed from upper left side thereof in the image-forming apparatus according to the embodiment.
Figure 7:
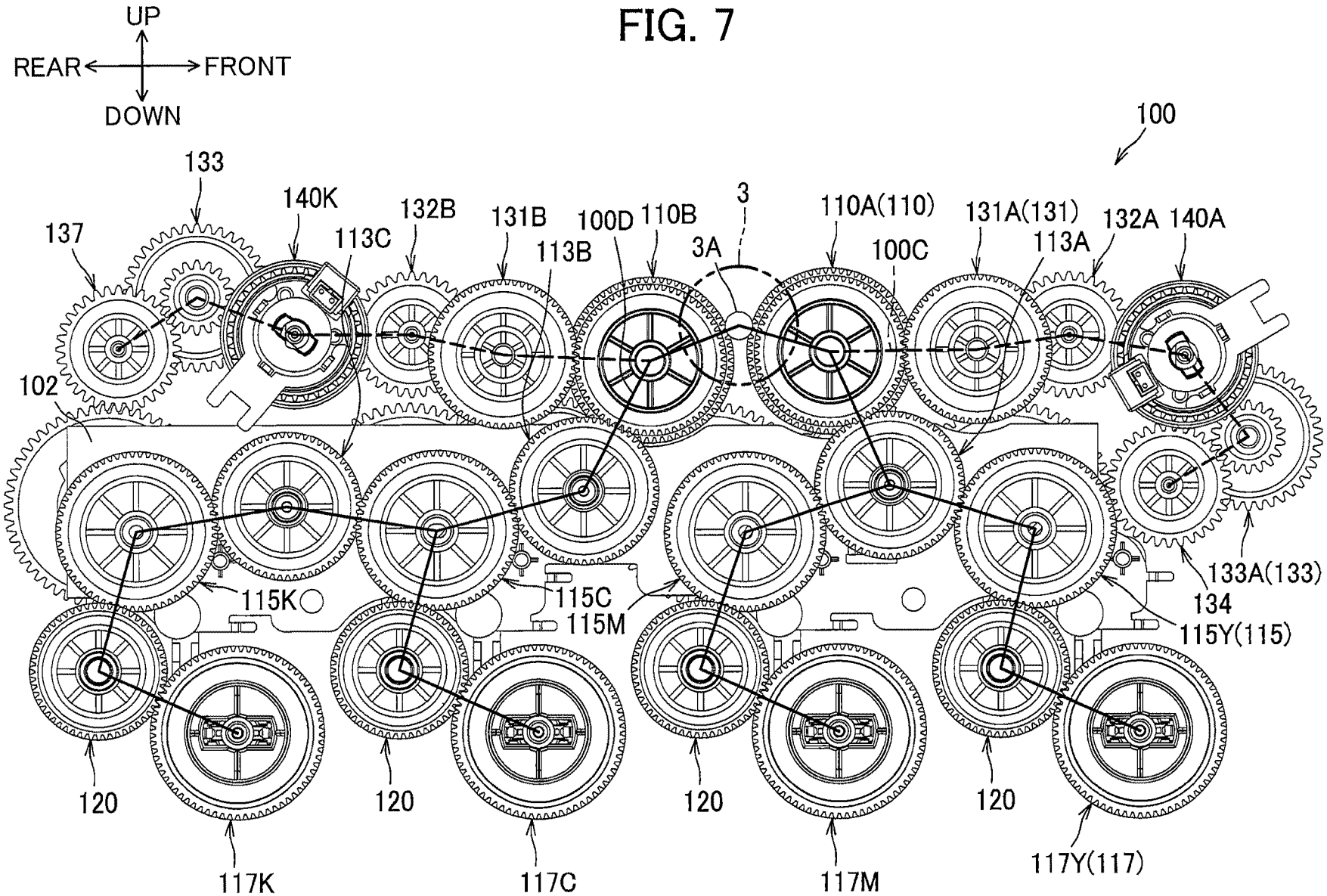
FIG. 7 is a view illustrating the power transmission mechanism as viewed from a left side thereof in an axial direction thereof.

As illustrated in FIGS. 6 and 7, the image-forming apparatus 1 further includes: the motor 3 configured to supply driving force to the cams 150; and the power transmission mechanism 100 configured to transmit the driving force of the motor 3 to the first developing roller 61Y, the second developing roller 61M, the third developing roller 61C, and the fourth developing roller 61, respectively. Each of the above-described cams 150 (constituting part of each separation mechanism 5) is mechanically connected to the power transmission mechanism 100. The power transmission mechanism 100 is configured not to transmit the driving force of the motor 3 to the first developing roller 61Y, the second developing roller 61M, the third developing roller 61C and the fourth developing roller 61K when these developing rollers 61 are at their respective separated positions.

Figure 9:
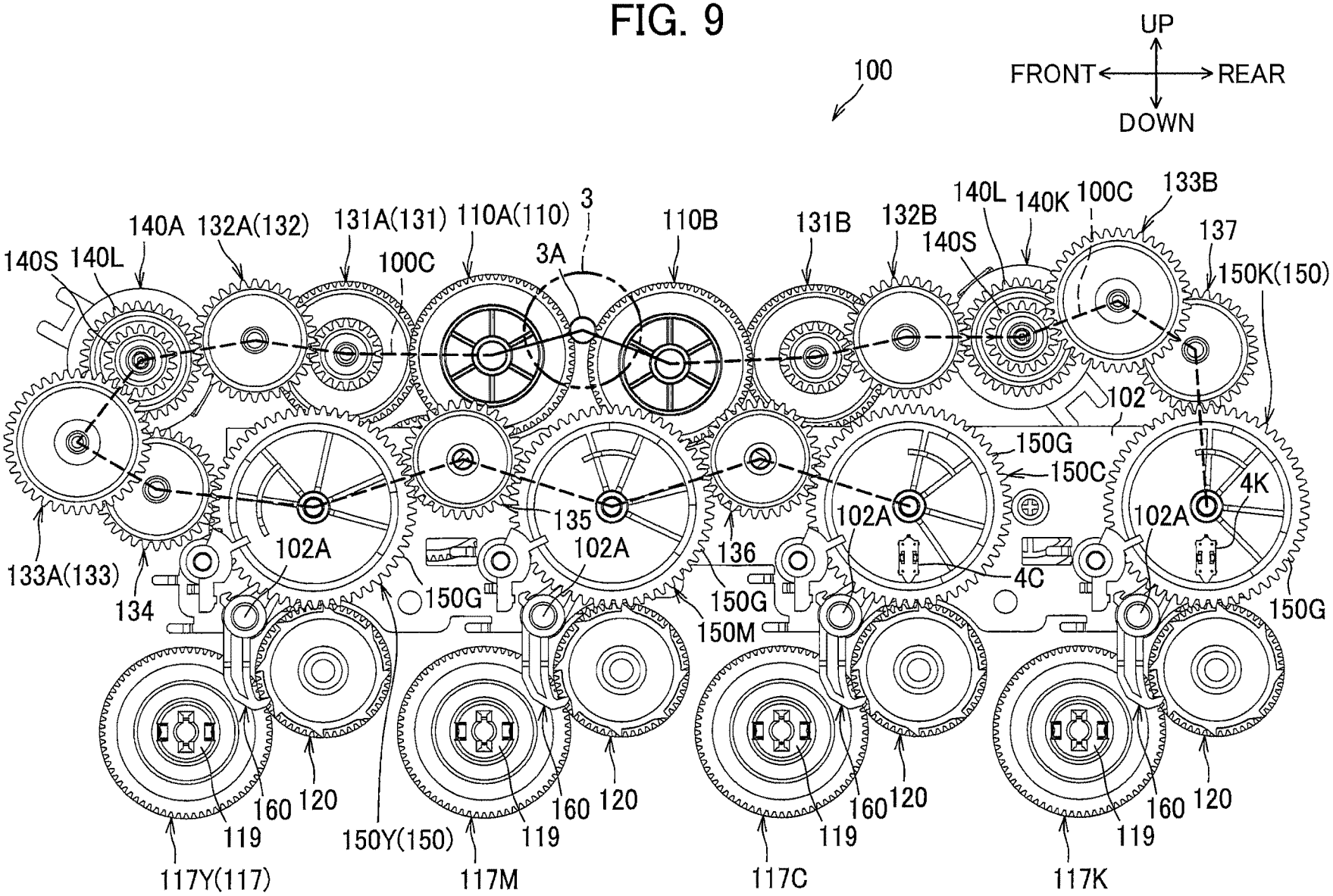
FIG. 9 is a view illustrating the power transmission mechanism as viewed from a right side thereof in the axial direction.

As best illustrated in FIG. 7, the power transmission mechanism 100 includes: a power transmission gear train 100D configured to transmit the driving force of the motor 3 to the respective developing rollers 61; and a transmission control gear train 100C configured to control transmission of the driving force of the power transmission gear train 100D. The power transmission gear train 100D is mechanically connected to the transmission control gear train 100C. In FIGS. 7 and 9, meshing engagement of the gears in the power transmission gear train 100D is indicated by a bold solid line, and meshing engagement of the gears in the transmission control gear train 100C is indicated by a bold broken line.

The power transmission gear train 100D includes: two first idle gears 110 (110A, 110B); three second idle gears 113A, 113B and 113C; four third idle gears 115 (115Y, 115M, 115C, 115K); four clutches 120; and four coupling gears 117 (117Y, 117M, 117C, 117K). Each of these gears constituting the power transmission gear train 100D is supported by the support plate 102 or a frame (not illustrated) of the housing 10 so as to be rotatable about an axis extending in the axial direction.

The motor 3 includes an output shaft 3A. A gear (not illustrated) is concentrically fixed to the output shaft 3A.

As illustrated in FIG. 6, each first idle gear 110 is a two-stage gear including a large diameter gear 110L and a small diameter gear 110S. The small diameter gear 110S has a certain number of gear teeth which is smaller than a number of gear teeth of the large diameter gear 110L. The large diameter gear 110L is rotatable integrally with the small diameter gear 110S. The first idle gear 110A is positioned frontward of the output shaft 3A, and the other first idle gear 110B is positioned rearward of the output shaft 3A. The large diameter gear 110L of each first idle gear 110 is in meshing engagement with the gear of the output shaft 3A.

As illustrated in FIG. 7, the second idle gear 113A is in meshing engagement with the small diameter gear 110S of the front first idle gear 110A. The second idle gear 113B is in meshing engagement with the small diameter gear 110S of the rear first idle gear 110B.

The four third idle gears 115Y, 115M, 115C and 115K are provided in one-to-one correspondence with each of the four colors, and are arrayed in this order in a front-to-rear direction. The third idle gears 115Y and 115M are in meshing engagement with the second idle gear 113A. The third idle gear 115C is in meshing engagement with the second idle gear 113B and the second idle gear 113C. The third idle gear 115K is in meshing engagement with the second idle gear 113C. Hence, the third idle gear 115K is driven by the third idle gear 115C through the second idle gear 113C.

The four clutches 120 have the same structure as one another. Each clutch 120 is in meshing engagement with one of the four third idle gears 115 (one of the third idle gears 115Y, 115M, 115C and 115K) to receive the driving force from the third idle gear 115. A structure of the clutch 120 will be described later in detail.

Each coupling gear 117 is in meshing engagement with one of the clutches 120. Each coupling gear 117 includes the coupling shaft 119 rotatable integrally and coaxially therewith (FIG. 6). The coupling shaft 119 is movable in the axial direction in interlocking relation to the opening/closing movement of the front cover 11. The coupling shaft 119 is configured to be engaged with the coupling 65 (FIG. 3A) of the corresponding developing cartridge 60 in accordance with the closing motion of the front cover 11.

In the power transmission gear train 100D, the coupling gear 117Y for the color of yellow is configured to receive the driving force from the motor 3 through the first idle gear 110A, the second idle gear 113A, the third idle gear 115Y, and the clutch 120.

The coupling gear 117M for the color of magenta is configured to receive the driving force from the motor 3 through the first idle gear 110A, the second idle gear 113A, the third idle gear 115M, and the clutch 120.

The coupling gear 117C for the color of cyan is configured to receive the driving force from the motor 3 through the first idle gear 110B, the second idle gear 113B, the third idle gear 115C, and the clutch 120.

The coupling gear 117K for the color of black is configured to receive the driving force from the motor 3 through the first idle gear 110B, the second idle gear 113B, the third idle gear 115C, the second idle gear 113C, the third idle gear 115K, and the clutch 120.

As illustrated in FIGS. 8 and 9, the transmission control gear train 100C includes: two fourth idle gears 131 (131A, 131B); two fifth idle gears 132 (132A, 132B); a YMC clutch 140A; a K clutch 140K; two sixth idle gears 133 (133A, 133B); a seventh idle gear 134; an eighth idle gear 135; a ninth idle gear 136; a tenth idle gear 137; and the cams 150 (150Y, 150M, 150C, 150K). These gears constituting the transmission control gear train 100C are supported by the support plate 102 or the frame (not illustrated) of the housing 10 so as to be rotatable about their axes extending in the axial direction.

Each fourth idle gear 131 is a two-stage gear including a large diameter gear 131L and a small diameter gear 131S (FIG. 8). The small diameter gear 131S has a certain number of gear teeth is smaller than a number of gear teeth of the large diameter gear 131L. The large diameter gear 131L is rotatable integrally with the small diameter gear 131S. The fourth idle gear 131A is positioned frontward of the first idle gear 110A, and the other fourth idle gear 131B is positioned rearward of the first idle gear 110B. The large diameter gear 131L of each fourth idle gear 131 is in meshing engagement with the small diameter gear 110S of the first idle gear 110 (first idle gear 110A or 110B).

Of the two fifth idle gears 132, the fifth idle gear 132A is positioned frontward of the fourth idle gear 131A, and the fifth idle gear 132B is positioned rearward of the fourth idle gear 131B. The fifth idle gear 132A is in meshing engagement with the small diameter gear 131S of the fourth idle gear 131A, and the fifth idle gear 132B is in meshing engagement with the small diameter gear 131S of the fourth idle gear 131B.

The YMC clutch 140A is configured to change-over transmission and cut-off of the driving force to the cams 150 with respect to the color of yellow, magenta, and cyan in the transmission control gear train 100C. That is, the YMC clutch 140A is configured to perform switching of the cams 150Y, 150M and 150C between their rotating state and non-rotating state.

The YMC clutch 140A is configured to connect the motor 3 and the cams 150Y, 150M and 150C to allow transmission of the driving force of the motor 3 to the cams 150Y, 150M and 150C for rotating the cams 150Y, 150M and 150C. The YMC clutch 140A is also configured to disconnect the connection between motor 3 and the cams 150Y, 150M and 150C to cut off the transmission of the driving force of the motor 3 to the cams 150Y, 150M and 150C for stopping the rotations of these cams 150Y, 150M and 150C.

The YMC clutch 140A includes a large diameter gear 140L and a small diameter gear 140S whose number of gear teeth is smaller than a number of gear teeth of the large diameter gear 140L. The YMC clutch 140A is positioned frontward of the fifth idle gear 132A, and the large diameter gear 140L of the YMC clutch 140A is in meshing engagement with the fifth idle gear 132A.

An electromagnetic clutch is available as the YMC clutch 140. Upon receipt of power supply (turning ON), the large diameter gear 140L and the small diameter gear 140S integrally rotate together, and upon halting of the power supply (turning OFF), the large diameter gear 140L idly rotates to prevent rotation of the small diameter gear 140S.

The K clutch 140K has a structure the same as that of the YMC clutch 140A. The K clutch 140K is configured to change-over transmission and cut-off of the driving force to the cam 150 with respect to the color of black (i.e., the cam 150K) in the transmission control gear train 100C. As in the YMC clutch 140A, the K clutch 140K includes the large diameter gear 140L and the small diameter gear 140S whose number of gear teeth is smaller than that of the large diameter gear 140L. The K clutch 140K is positioned rearward of the fifth idle gear 132B, and the large diameter gear 140L of the K clutch 140K is in meshing engagement with the fifth idle gear 132B. Each of the two sixth idle gears 133 is a two-stage gear including a large diameter gear 133L and a small diameter gear 133S whose number of gear teeth is smaller than that of the large diameter gear 133L (FIG. 6). The large diameter gear 133L and the small diameter gear 133S rotate integrally. Specifically, the sixth idle gear 133A is positioned frontward of the K clutch 140K, and the sixth idle gear 133B is positioned rearward of the K clutch 140K. The large diameter gear 133L of the sixth idle gear 133A is in meshing engagement with the small diameter gear 140S of the YMC clutch 140A, and the large diameter gear 133L of the sixth idle gear 133B is in meshing engagement with the small diameter gear 140S of the K clutch 140K.

The seventh idle gear 134 is positioned between the sixth idle gear 133A and the cam 150Y. The seventh idle gear 134 is in meshing engagement with the small diameter gear 133S (FIG. 6) of the sixth idle gear 133A and the gear portion 150G of the cam 150Y.

The eighth idle gear 135 is positioned between the cam 150Y and the cam 150M. The eighth idle gear 135 is in meshing engagement with the gear portion 150G of the cam 150Y and the gear portion 150G of the cam 150M.

The ninth idle gear 136 is positioned between the cam 150M and the cam 150C. The ninth idle gear 136 is in meshing engagement with the gear portion 150G of the cam 150M and the gear portion 150G of the cam 150C.

The tenth idle gear 137 is positioned between the sixth idle gear 133B and the cam 150K. The tenth idle gear 137 is in meshing engagement with the small diameter gear 133S of the sixth idle gear 133B (FIG. 6) and the gear portion 150G of the cam 150K.

In the transmission control gear train 100C, the yellow cam 150Y is configured to receive the driving force of the motor 3 through the first idle gear 110A, the fourth idle gear 131A, the fifth idle gear 132A, the YMC clutch 140A, the sixth idle gear 133A, and the seventh idle gear 134. Further, the magenta cam 150M is configured to receive the driving force from the yellow cam 150Y through the eighth idle gear 135. Further, the cyan cam 150C is configured to receive the driving force from the magenta cam 150M through the ninth idle gear 136. Upon power supply to the YMC clutch 140A, the cams 150Y, 150M and 150C are configured to rotate concurrently, and upon halting of the power supply to the YMC clutch 140A, the cams 150Y, 150M and 150C are configured to stop rotating.

On the other hand, the black cam 150K is configured to receive the driving force of the motor 3 through the first idle gear 110B, the fourth idle gear 131B, the fifth idle gear 132B, the K clutch 140K, the sixth idle gear 133B, and the tenth idle gear 137. Upon power supply to the K clutch 140K, the cam 150K is configured to rotate, and the cam 150K is configured to stop rotating upon halting of the power supply to the K clutch 140K.

Next, a structure and functions of the clutch 120 will be described.

Figure 10A:
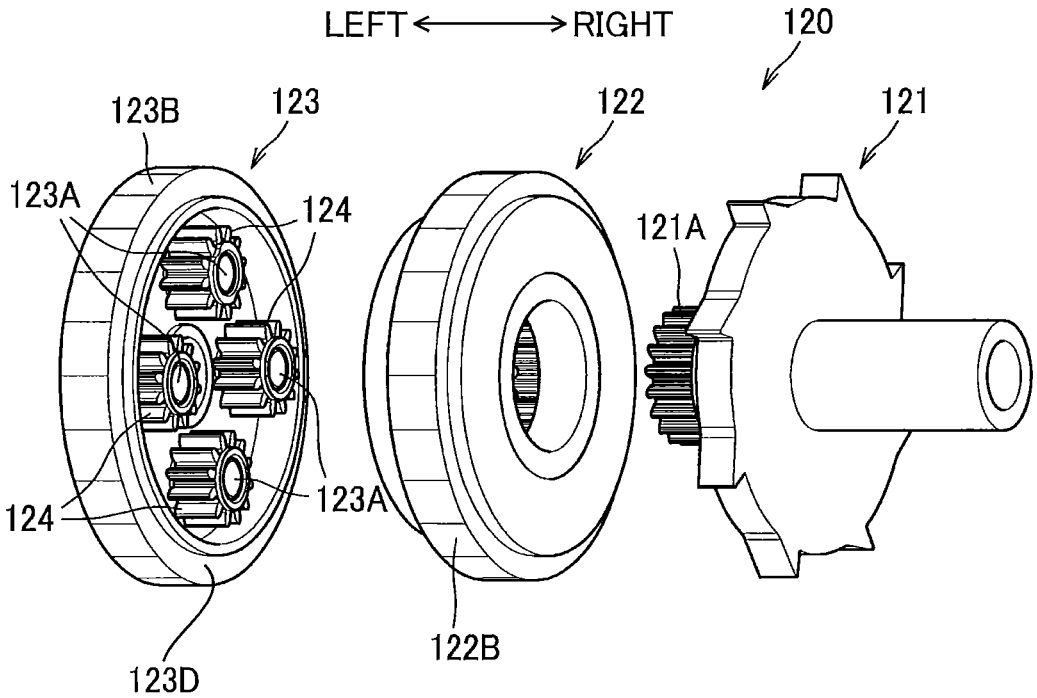
FIG. 10A is an exploded perspective view illustrating a clutch as viewed from a sun gear side thereof in the image-forming apparatus according to the embodiment.
Figure 10B:
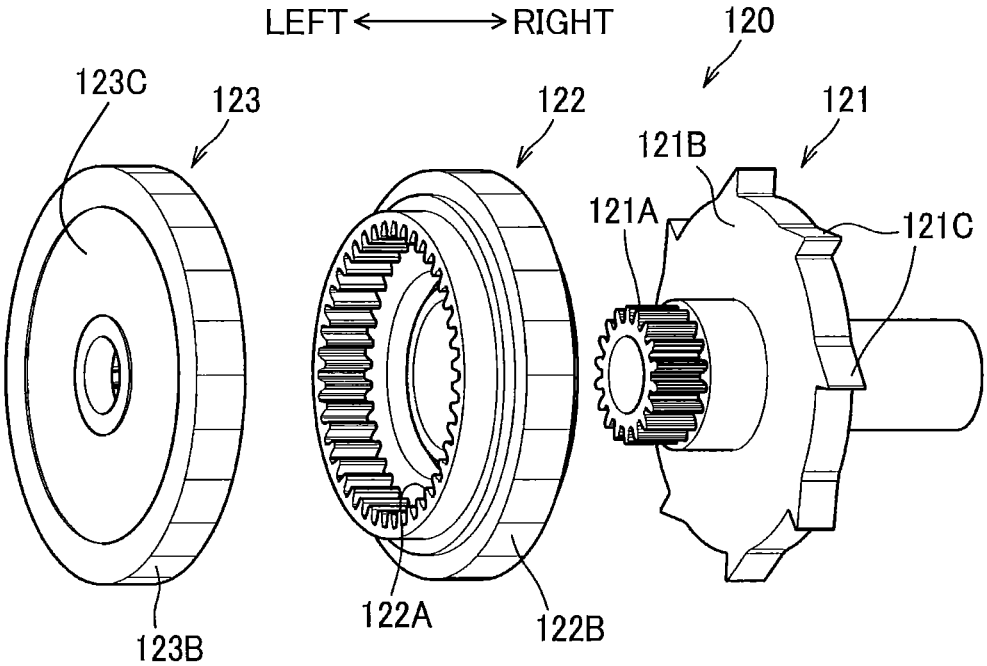
FIG. 10B is an exploded perspective view illustrating the clutch as viewed from a carrier side thereof in the mage forming apparatus according to the embodiment.

As illustrated in FIGS. 10A and 10B, each clutch 120 includes a planetary gear mechanism. The clutch 120 is configured to perform change-over between the transmission state where the driving force of the motor 3 is transmitted to the developing roller 61 and a cut-off state where the driving force is not transmitted to the developing roller 61. Specifically, the clutch 120 includes: a sun gear 121 rotatable about an axis thereof; a ring gear 122; a carrier 123; and a plurality of (four) planetary gears 124 supported by the carrier 123. The ring gear 122 and carrier 123 are rotatable coaxially about the axis of the sun gear 121.

The sun gear 121 includes a gear portion 121A, a disc portion 121B rotatable integrally with the gear portion 121A, and a plurality of pawls 121C provided at an outer peripheral surface of the disc portion 121B. The pawls 121C have acute tip end portions each of which is inclined toward upstream in a rotational direction of the sun gear 121 along the outer peripheral surface. The ring gear 122 has an annular shape having an inner peripheral surface provided with an inner gear 122A and an outer peripheral surface provided with an input gear 122B.

The carrier 123 includes: a circular portion 123C; an annular portion 123D extending from an inner surface of the circular portion 123C; four shaft portions 123A each extending from the inner surface of the circular portion 123C; and an output gear 123B provided at an outer peripheral surface of the annular portion 123D.

Each of the four planetary gears 124 is rotatably supported by one of the four shaft portions 123A. Each planetary gear 124 is in meshing engagement with the gear portion 121A of the sun gear 121, and with the inner gear 122A of the ring gear 122.

As illustrated in FIGS. 6 and 7, the input gear 122B of each clutch 120 is in meshing engagement with the corresponding third idle gear 115, and the output gear 123B is in meshing engagement with the corresponding coupling gear 117.

In a state where the rotation of the sun gear 121 is stopped, the driving force input into the input gear 122B can be transmitted to the output gear 123B (the transmission state). On the other hand, in a state where the sun gear 121 is allowed to rotate, the driving force input into the input gear 122B cannot be transmitted to the output gear 123B (the cut-off state). In a state where the clutch 120 is at the cut-off state and the driving force is input into the input gear 122 while load is imparted on the output gear 123B, the output gear 123B does not rotate and the sun gear 121 idly rotates.

As illustrated in FIG. 9, the power transmission mechanism 100 further includes a plurality of (four) the levers 160 corresponding to the respective four colors. Four support shafts 102A are fixed to and extends from the support plate 102. Each lever 160 is pivotally movably supported by the corresponding one of the support shafts 102A. Each lever 160 is configured, in cooperation with the corresponding cam 150, to engage the sun gear 121 of the planetary gear mechanism in the corresponding clutch 120 to prevent the rotation of the sun gear 121 to provide the transmission state, and to disengage from the sun gear 121 to provide the cut-off state.

Specifically, as illustrated in FIG. 11A, each lever 160 includes a rotation support portion 161, a first arm 162 extending from the rotation support portion 161, and a second arm 163 extending from the rotation support portion 161 in a direction different from an extending direction of the first arm 162.

The rotation support portion 161 is hollow cylindrical. The corresponding support shaft 102A of the support plate 102 is inserted in a hollow space of the rotation support portion 161. Hence, the rotation support portion 161 is supported by the support shaft 102A.

The second arm 163 has a tip end portion extending toward the outer peripheral surface of the disc portion 121B of the sun gear 121 of the corresponding clutch 120. The lever 160 is urged by a torsion spring (not illustrated) so that the tip end portion of the second arm 163 is urged toward the outer peripheral surface of the disc portion 121B. A hook 163A is provided at the tip end portion of the second arm 163. The hook 163A is configured to engage any one of the pawls 121C of the sun gear 121 to prevent the sun gear 121 from rotating.

The first arm 162 has a tip end portion 162A contactable with the second cam portion 153B of the corresponding cam 150. Specifically, the lever 160 is pivotally movable between an engagement position and a disengagement position. In the engagement position, the tip end portion 162A is positioned in confrontation with the circular base portion 153A, so that the hook 163A is engaged with one of the pawls 121C of the corresponding clutch 120 (see FIGS. 11A-13B). In the disengagement position, the tip end portion 162A of the first arm 162 comes into contact with the second cam portion 153B to be urgingly moved by the same, so that the hook 163A is disengaged from the pawl 121C (see FIGS. 14A-15B). The engagement position of the lever 160 separated from the second cam portion 153B brings the clutch 120 into the transmission state, and the disengagement position of the lever 160 in contact with the second cam portion 153B brings the clutch 120 into the cut-off state.

<Operations of the Cam 150, Lever 160, Clutch 120 and Cam Follower 170>

Operations of the lever 160, the clutch 120, the cam 150 and the cam follower 170 will be described with reference to FIGS. 11A through 15B. The components illustrated in these drawings are for the color of yellow. Components corresponding to the other colors have the same structure as the components illustrated in FIGS. 11A through 15B except for the difference in the phase of each cam 150.

As illustrated in FIGS. 11A and 11B, the tip end portion 162A of the first arm 162 is brought into confrontation with the circular base portion 153A after the tip end portion 162A is separated from the second cam portion 153B. Hence, the hook 163A of the second arm 163 is brought into engagement with one of the pawls 121C of the sun gear 121 of the corresponding clutch 120 to position the lever 160 at its engagement position. Since the rotation of the sun gear 121 is stopped by the lever 160, the clutch 120 is brought to the transmission state where the output gear 123B rotates in accordance with the rotation of the input gear 122B. Hence, the driving force of the motor 3 can be transmitted to the developing roller 61, and accordingly, the developing roller 61 is rotatable by the rotation of the motor 3 through the power transmission gear train 100D. Further, the end face (left end face) of the contact portion 172 of the cam follower 170 is positioned on the first holding surface F1 of the cam surface 152F of the cam 150. Therefore, the slide shaft portion 171 is positioned to be spaced away from the slide member 64 of the developing cartridge 60 in the axial direction (see FIG. 4A). Accordingly, the developing roller 61 is positioned at its contact position.

Figure 12A:
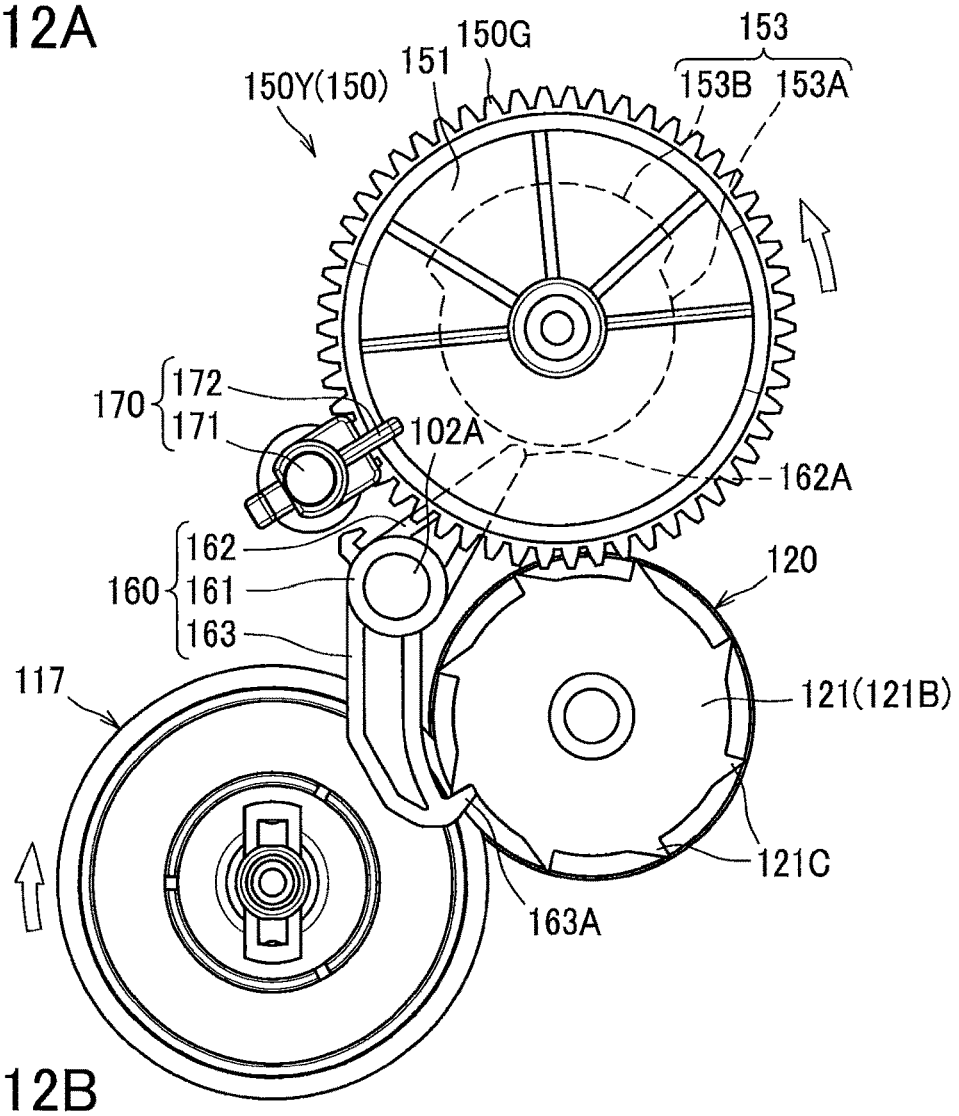
FIG. 12A is a view illustrating the separation mechanism, the lever, the clutch, and the coupling gear in a state where the cam rotates from the state of FIG. 11A and the developing roller corresponding to the color of yellow is at the contact position to perform image formation as viewed in the axial direction.
Figure 12B:
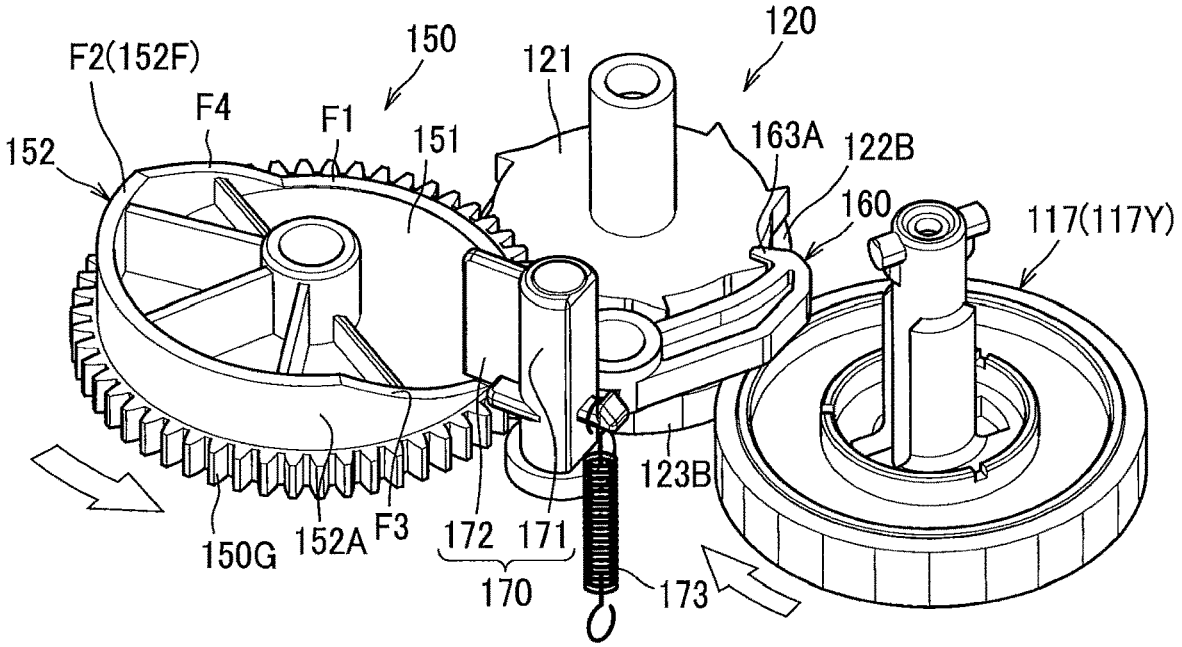
FIG. 12B is a perspective view illustrating the separation mechanism, the lever, the clutch, and the coupling gear in the state where the cam rotates from the state of FIG. 11A and the developing roller corresponding to the color of yellow is at the contact position for performing image formation.

As illustrated in FIGS. 12A and 12B, in accordance with further rotation of the cam 150 from the state illustrated in FIGS. 11A, and 11B, the contact portion 172 of the cam follower 170 slidingly moves over the first holding surface F1 of the cam 150 and approaches the first guide surface F3. Among the four cams 150, in particular, in a case where the rotation of the yellow cam 150Y is to be stopped while the developing roller 61 is at the contact position, the rotation of the yellow cam 150Y is stopped when the contact portion 172 is at such a position in contact with the first guide surface F3, the position being closer to the first holding surface F1 than to the second holding surface F2, as illustrated in FIG. 12B.

Incidentally, at this time, the contact portion 172 of the cam follower 170 may be only in contact with the first guide surface F3. Alternatively, the contact portion 172 may be in contact with both of the first guide surface F3 and the first holding surface F1.

Figure 13A:
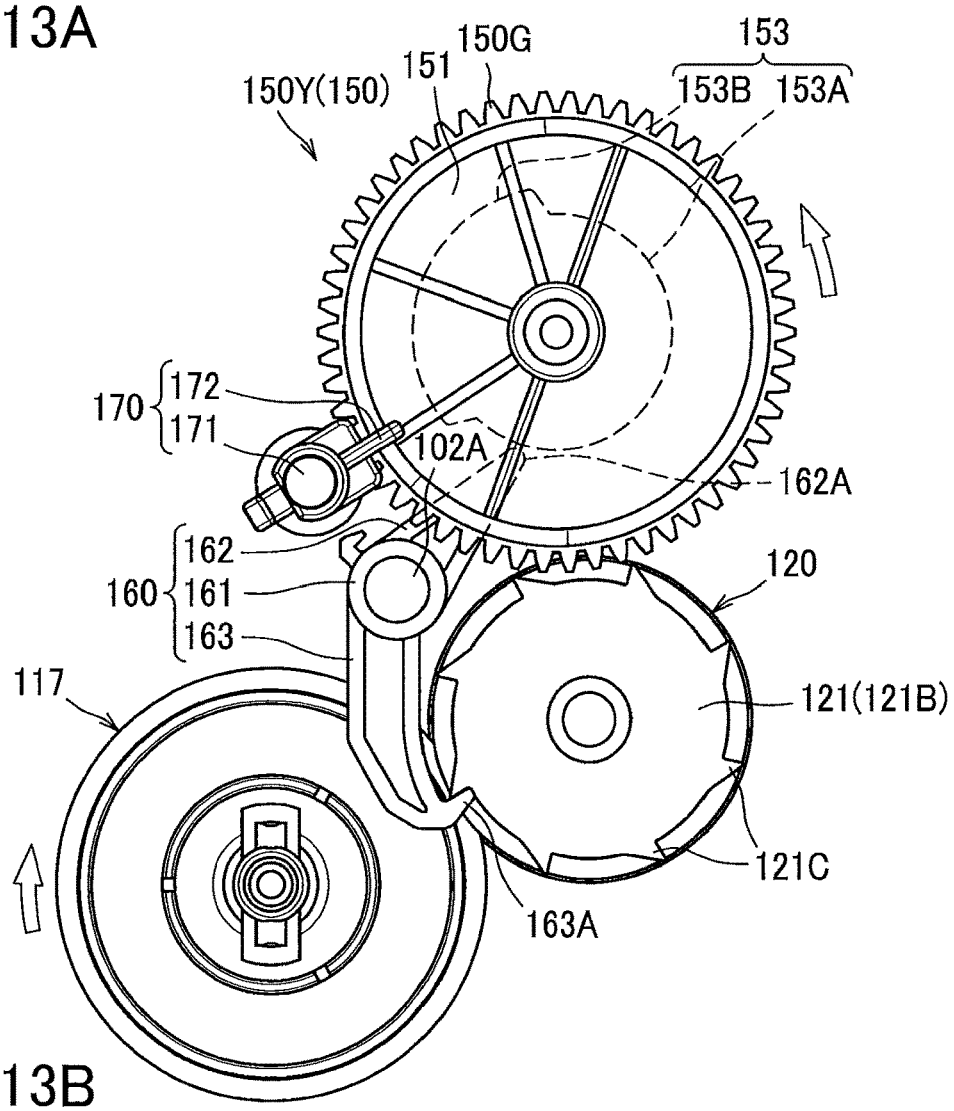
FIG. 13A is a view illustrating the separation mechanism, the lever, the clutch, and the coupling gear in a state where the cam further rotates from the state of FIG. 12A and the developing roller is at a separated position thereof and the clutch is at the transmission state as viewed in the axial direction.
Figure 13B:
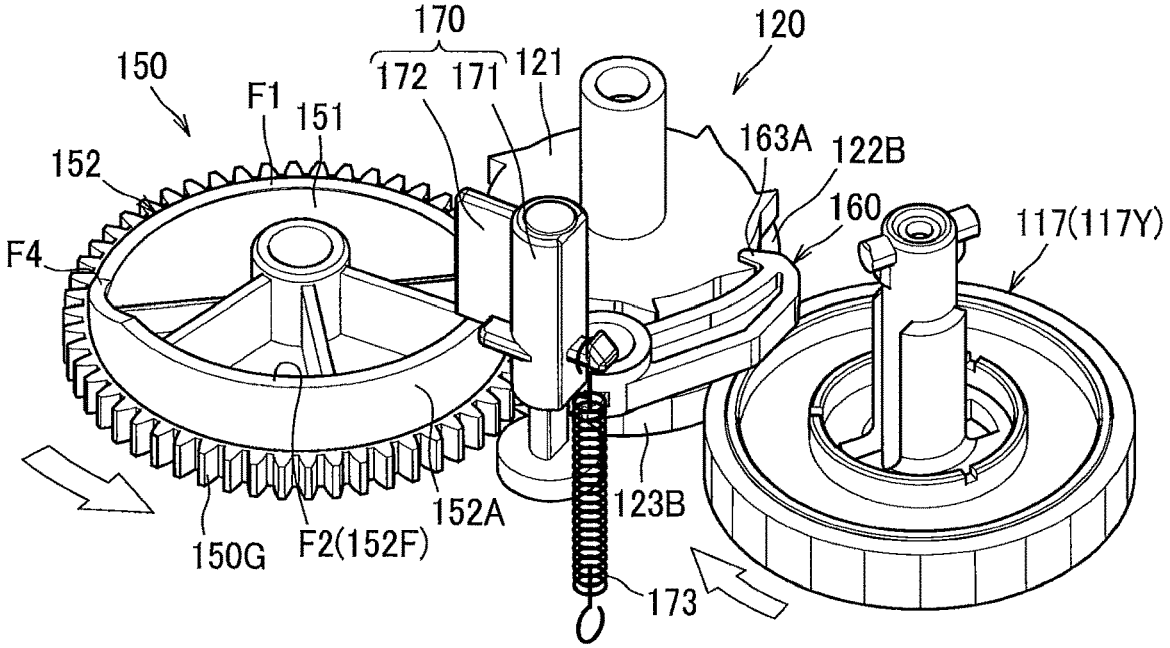
FIG. 13B is a perspective view illustrating the separation mechanism, the lever, the clutch, and the coupling gear in the state where the cam further rotates from the state of FIG. 12A and the developing roller is at the separated position and the clutch is at the transmission state.

In order to separate the developing roller 61 away from the photosensitive drum 50, the cam 150Y is further rotated from the state illustrated in FIGS. 12A and 12B, so that the contact portion 172 of the cam follower 170 slidingly moves over the first guide surface F3 and is brought into contact with the second holding surface F2, as illustrated in FIGS. 13A and 13B. Hence, the slide shaft portion 171 of the cam follower 170 pushes the slide member 64 of the developing cartridge 60 in the axial direction (rightward), so that the developing cartridge 60 is pushed frontward by the reaction force from the counterpart abutment portions 94 provided on the support member 90 (see FIG. 4B).

The developing roller 61 is thus separated from the photosensitive drum 50 in a state where the contact portion 172 is positioned on a region of the first guide surface F3, the region being closer to the second holding surface F2 than to the first holding surface F1. The separated position of the developing roller 61 is maintained as long as the contact portion 172 is positioned on the second holding surface F2.

Figure 14A:
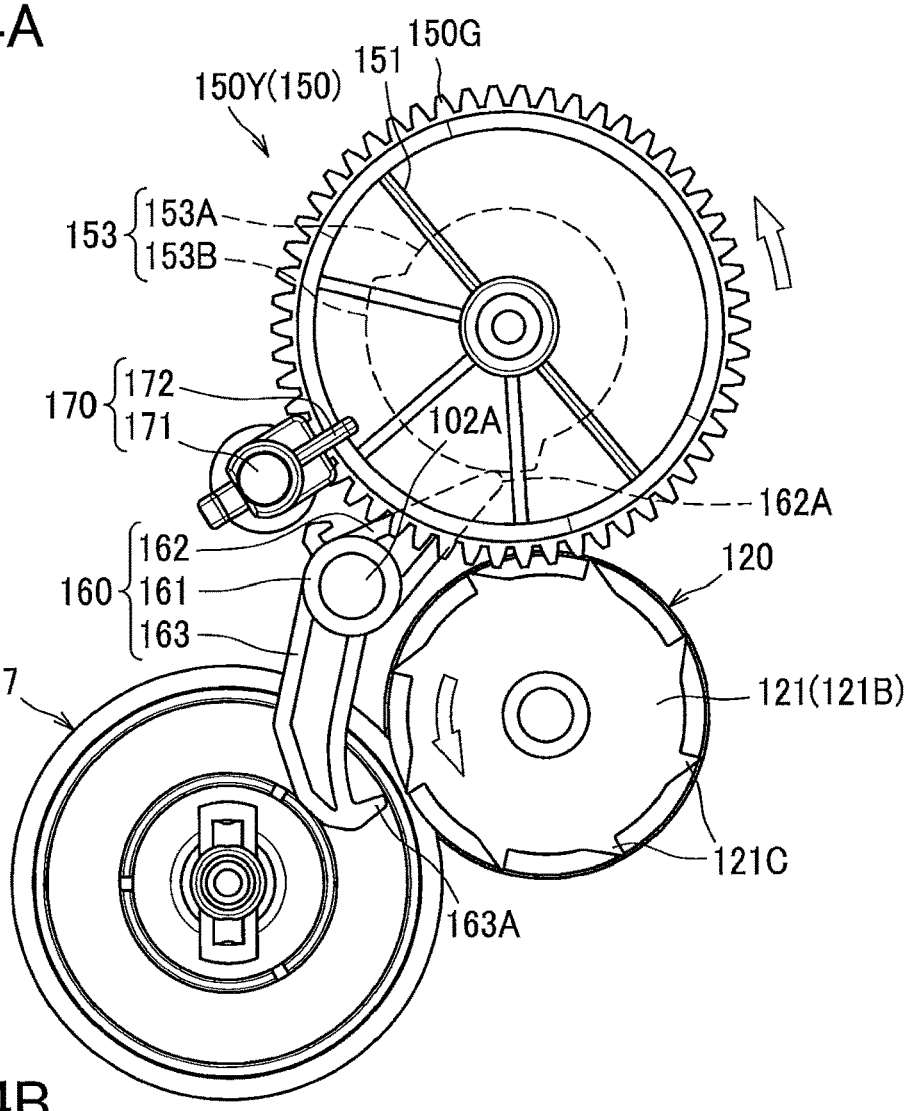
FIG. 14A is a view illustrating the separation mechanism, the lever, the clutch, and the coupling gear in a state where the cam further rotates from the state of FIG. 13A and the developing roller is at the separated position and the clutch is at a cut off state as viewed in the axial direction.
Figure 14B:
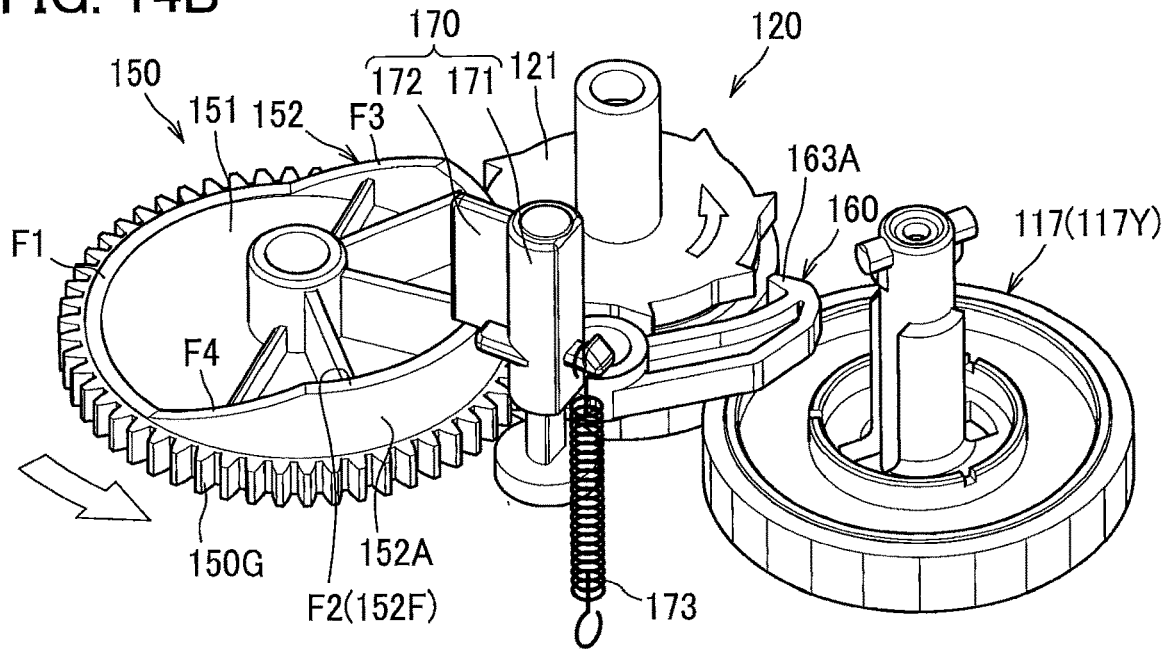
FIG. 14B is a perspective view illustrating the separation mechanism, the lever, the clutch, and the coupling gear in the state where the cam further rotates from the state of FIG. 13A and the developing roller is at the separated position and the clutch is at the cut off state.

As illustrated in FIGS. 14A and 14B, the cam 150 further rotates after the developing roller 61 is positioned at the separated position, so that the tip end portion 162A of the first arm 162 of the lever 160 is brought into contact with the second cam portion 153B. The lever 160 is pivotally moved by the first arm 162 being pushed by the second cam portion 153B. Hence, the hook 163A is disengaged from the pawl 121C of the sun gear 121, thereby providing the disengagement position of the lever 160.

Since the lever 160 no longer stops rotation of the sun gear 121 of the clutch 120 at this time, the clutch 120 is switched to the cut-off state where the output gear 123B does not perform power transmission during the rotation of the input gear 122B. Accordingly, the driving force of the motor 3 cannot be transmitted to the developing roller 61. That is, the rotation of the motor 3 does not cause rotation of the developing roller 61, but only causes idle rotation of the sun gear 121.

Figure 15A:
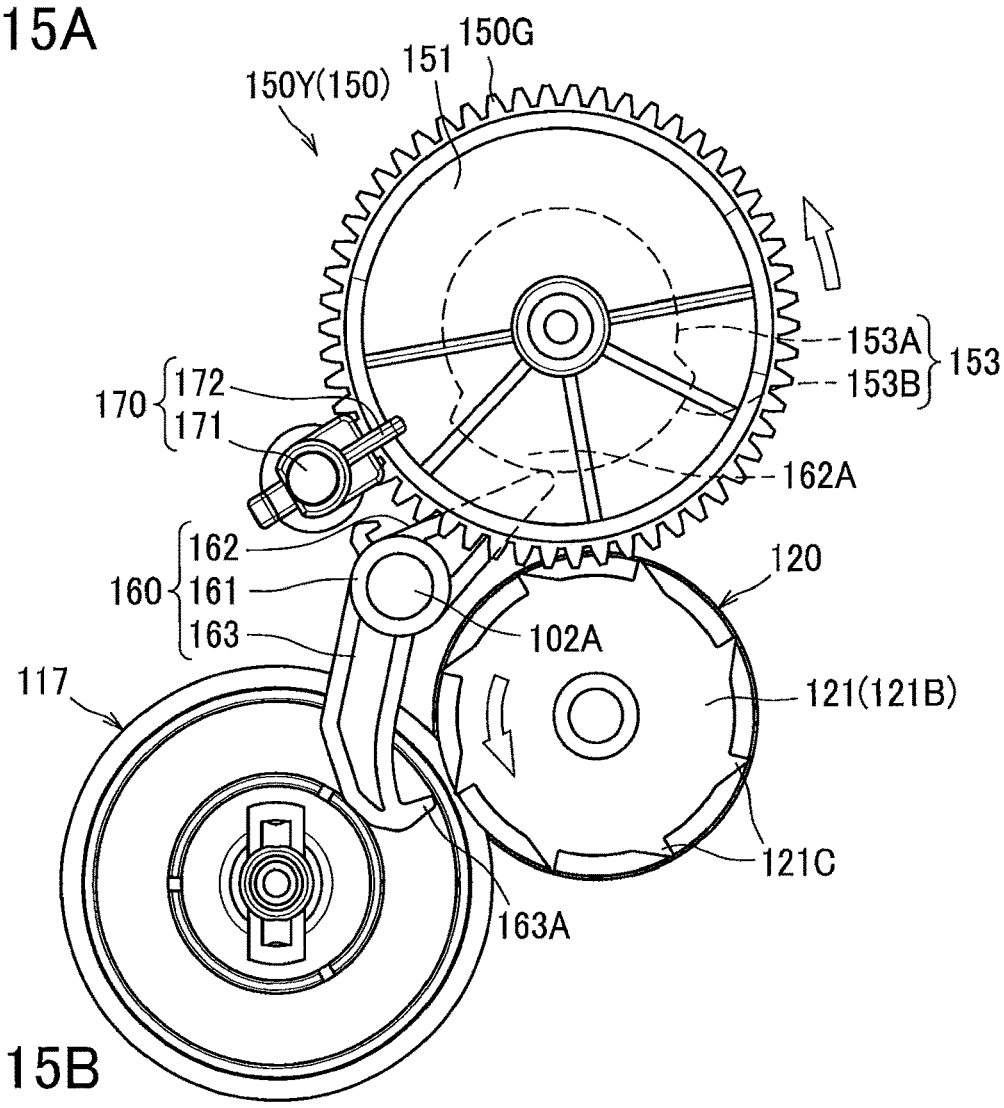
FIG. 15A is a view illustrating the separation mechanism, the lever, the clutch, and the coupling gear in a state where the cam further rotates from the state of FIG. 14A and the developing roller corresponding to the color of yellow temporarily stops rotating immediately before starting to move to the contact position as viewed in the axial direction.
Figure 15B:
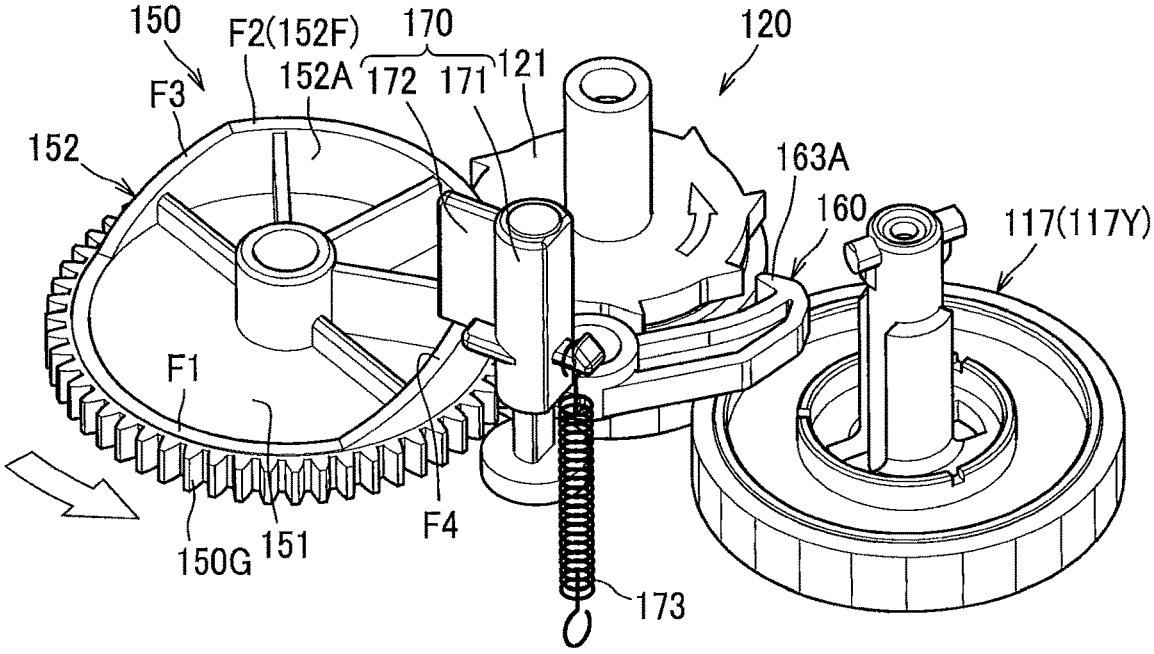
FIG. 15B is a perspective view illustrating the separation mechanism, the lever, the clutch, and the coupling gear in the state where the cam further rotates from the state of FIG. 14A and the developing roller corresponding to the color of yellow temporarily stops rotating immediately before starting to move to the contact position.

In order to maintain the separated position of the developing roller 61, the rotation of the cam 150 is halted while the lever 160 is at the disengagement position illustrated in FIGS. 14A and 14B. For temporarily stopping the rotation of the yellow cam 150Y while the developing roller 61Y is at the separated position, the cam 150Y is further rotated from the state illustrated in FIGS. 14A and 14B. Then, as illustrated in FIGS. 15A and 15B, the rotation of the yellow cam 150Y is stopped when the contact portion 172 reaches an end of the second holding surface F2, the end being immediately upstream of the second guide surface F4. That is, the contact portion 172 is stopped immediately before moving onto the second guide surface F4 (before coming into contact with the second guide surface F4).

In order to move the developing roller 61 from the separated position to the contact position, the cam 150 is further rotated from the state illustrated in FIGS. 14A and 14B or FIGS. 15A and 15B. As a result, the contact portion 172 silidngly moves over the second guide surface F4 and comes to the position in contact with the first holding surface F1 by the urging force of the spring 173, as illustrated in FIGS. 11A and 11B.

Accordingly, the cam follower 170 is moved in the axial direction away from the slide member 64, so that the slide member 64 is moved leftward in FIG. 4A by the urging force of the spring 184.

Thus, the developing cartridge 60 is returned to the state depicted in FIG. 4A, i.e., to the contact position indicated by the solid line in FIG. 1 where the developing roller 61 is in contact with the photosensitive drum 50. The developing roller 61 is brought into contact with the photosensitive drum 50 when the contact portion 172 moves past a region of the second guide surface F4, the region being adjacent to the second holding surface F2 (see FIG. 15B).

In the meantime, the lever 160 is pivoted to the engagement position where the hook 163A of the second arm 163 engages the pawl 121C of the sun gear 121 since the tip end portion 162A of the first arm 162 faces the circular base portion 153A of the cam 150. The clutch 120 is thus rendered into the transmission state.

<Operations of the Controller 2>

In the image-forming apparatus 1, the first developing roller 61Y, the second developing roller 61M, the third developing roller 61C, and the fourth developing roller 61K are configured to be moved to the contact positions for transferring respective toner images to the sheet S in synchronism with the movement of the sheet S, and are configured to be moved in sequence to the separated positions after the transfer of the toner images to the sheet S.

To this effect, the cams 150Y, 150M and 150C are assembled so that the phases (angular positions) of the respective first cam portions 152A are displaced from one another by a predetermined angle (see FIG. 8). Specifically, the cams 150M and 150C have the same structure as each other. Further, the length of the first cam portion 152A of the yellow cam 150Y in the rotational direction is greater than the length of the cam 150M, 150C in the rotational direction thereof. Further, as illustrated in FIG. 8, the phases or angular positions of downstream ends of the respective first cam portions 152A are displaced from one another by a predetermined angle with respect to the cams 150Y, 150M, and 150C, whereas the phases or angular positions of upstream ends of the respective first cam portions 152A are coincident with each other with respect to the cams 150Y and 150M. Further, the structure of the cam 150K is identical to the structure of the cams 150M and 150C. However, the controller 2 is configured to control the cam 150K to start operating at a timing later by a predetermined angle (retardation in phase) than a timing at which the operations of the cams 150M and 150C are started.

The controller 2 is configured to control overall operations performed in the image-forming apparatus 1. The controller 2 includes a CPU, a ROM, a RAM, an input portion, and an output portion and the like. The controller 2 is configured to perform various processing by executing programs preliminarily stored therein.

The controller 2 is configured to control the YMC clutch 140A and the K clutch 140K in response to signals transmitted from the sheet feed sensor 28A, the front sensor 28B, the back sensor 28C, and the separation sensors 4K and 4C, thereby controlling the contact/separation of the developing rollers 61 relative to the respective photosensitive drums 50.

In the state where the second developing roller 61M, the third developing roller 61C, and the fourth developing roller 61K are at their separated positions, the developing cartridges 60M, 60C and 60K are respectively overlapped with the optical paths of the laser beams irradiating the photosensitive drums 50Y, 50M and 50C (the photosensitive drums 50 positioned adjacent to and upstream of the respective developing rollers 61M, 61C and 61K in the sheet conveying direction), as illustrated in FIG. 1. Therefore, the second developing roller 61M, the third developing roller 61C, and the fourth developing roller 61K are configured to be moved to the contact positions prior to irradiation of the laser beams toward the photosensitive drums 50Y, 50M and 50C, respectively.

The second developing roller 61M and the third developing roller 61C are configured to be moved to the contact positions prior to start of the exposure to the upstream photosensitive drums 50Y and 50M by the difference in length of the first cam portions 152A among the cams 150Y, 150M and 150C, and by the mechanical setting as to displacement of the phases of the cams 150Y, 150M and 150C.

Specifically, in order to move the second developing roller 61M to the contact position prior to the exposure to the first photosensitive drum 50Y, the cams 150Y and 150M are configured such that the second developing roller 61M comes into contact with the second photosensitive drum 50M at a timing concurrent with or prior to the timing at which the first developing roller 61Y comes into contact with the first photosensitive drum 60Y. That is, the timing is so set to satisfy an inequality t2≤t1, in which time t1 is defined as a time of contact of the first developing roller 61Y with the first photosensitive drum 50Y, and time t2 is defined as a time of contact of the second developing roller 61M with the second photosensitive drum 50M. More specifically, in the present embodiment, the time t1 is set to be equal to the time t2 (t1=t2).

For performing color printing, the controller 2 controls the cam 150K to be delayed by the predetermined angle against the cam 150C in association with the movement (moving timing) of the third developing roller 61C. That is, for performing color printing employing the first developing roller 61Y, the second developing roller 61M, the third developing roller 61C, and the fourth developing roller 61K, the controller 2 controls the third developing roller 61C and the fourth developing roller 61K to move to their contact positions prior to start of the exposure to the third photosensitive drum 50C.

The controller 2 further controls the third developing roller 61C to move to the separated position after termination of development with respect to the third photosensitive drum 50C and prior to termination of development with respect to the fourth photosensitive drum 50K. The controller 2 then permits the fourth developing roller 61K to move to the separated position after the termination of development with respect to the fourth photosensitive drum 50K.

On the other hand, for performing monochromatic printing employing only the fourth developing roller 61K, the controller 2 controls the fourth developing roller 61K to move to the contact position prior to start of the exposure to the fourth photosensitive drum 50K, while the first developing roller 61Y, the second developing roller 61M, and the third developing roller 61K are respectively maintained to be at the separated positions. Then, the controller 2 controls the fourth developing roller 61K to move to the separated position after termination of development with respect to the fourth photosensitive drum 50K.

Further, the controller 2 controls contacting timing of the most upstream first developing roller 61Y for the color of yellow with the first photosensitive drum 50Y in timed relation to conveying timing of the sheet S. That is, the controller 2 permits the cams 150Y, 150M and 150C to rotate within a time period prior to arrival of the sheet S at the first photosensitive drum 50Y and after start of conveyance of the sheet S.

Further, the controller 2 controls the YMC clutch 140A to stop rotation of the cams 150Y, 150M and 150C at a temporary stop timing. This temporary stop timing is a timing at which: a first time period T1 has elapsed from the timing at which the ON signal is not transmitted from the separation sensor 4C (the timing at which the signal turns OFF); and the first developing roller 61Y is in separation from the first photosensitive drum 50Y.

Then, the controller 2 controls the YMC clutch 140A to rotate the cams 150Y, 150M and 150C to bring the first developing roller 61Y into contact with the first photosensitive drum 50Y for image formation at a restart timing which is a timing at which a second time period T2 has elapsed from the timing at which the front sensor 28B functioning as the sheet sensor detects the leading edge of the sheet S.

After the restart timing, the controller 2 controls the YMC clutch 140A at a stop timing upon elapse of a third time period T3 from the restart timing to stop rotation of the cams 150Y, 150M and 150C. At this time (at the stop timing), the cam follower 170 in association with the yellow cam 150Y is in contact with the first guide surface F3 at a position closer to the first holding surface F1 than to the second holding surface F2 (FIG. 12B).

With such a control, the controller 2 stops rotation of the cams 150Y, 150M, 150C so that the cam follower 170 for the yellow cam 150Y is in contact with the first guide surface F3 and is located at a position closer to the first holding surface F1 than to the second holding surface F2, after intermittently rotating the cams 150Y, 150M and 150C for a predetermined time period from the timing at which ON signal is not acquired from the separation sensor 4C to the stop timing.

In a case where the developing rollers 61Y, 61M and 61C are moved from the separated position to the contact positions and to be maintained at the contact positions thereafter, the controller 2 stops rotations of the cams 150Y, 150M and 150C such that the cam follower 170 in association with the yellow cam 150Y is in contact with the first guide surface F3 at a position closer to the first holding surface F1 than to the second holding surface F2, after the controller 2 controls the YMC clutch 140A to rotate the cams 150Y, 150M and 150C to guide each cam follower 170 from each second holding surface F2 to each first holding surface F1 through each second guide surface F4.

Next, processing to be performed by the controller 2 will be described with reference to FIGS. 16 through 21.

Figure 16:
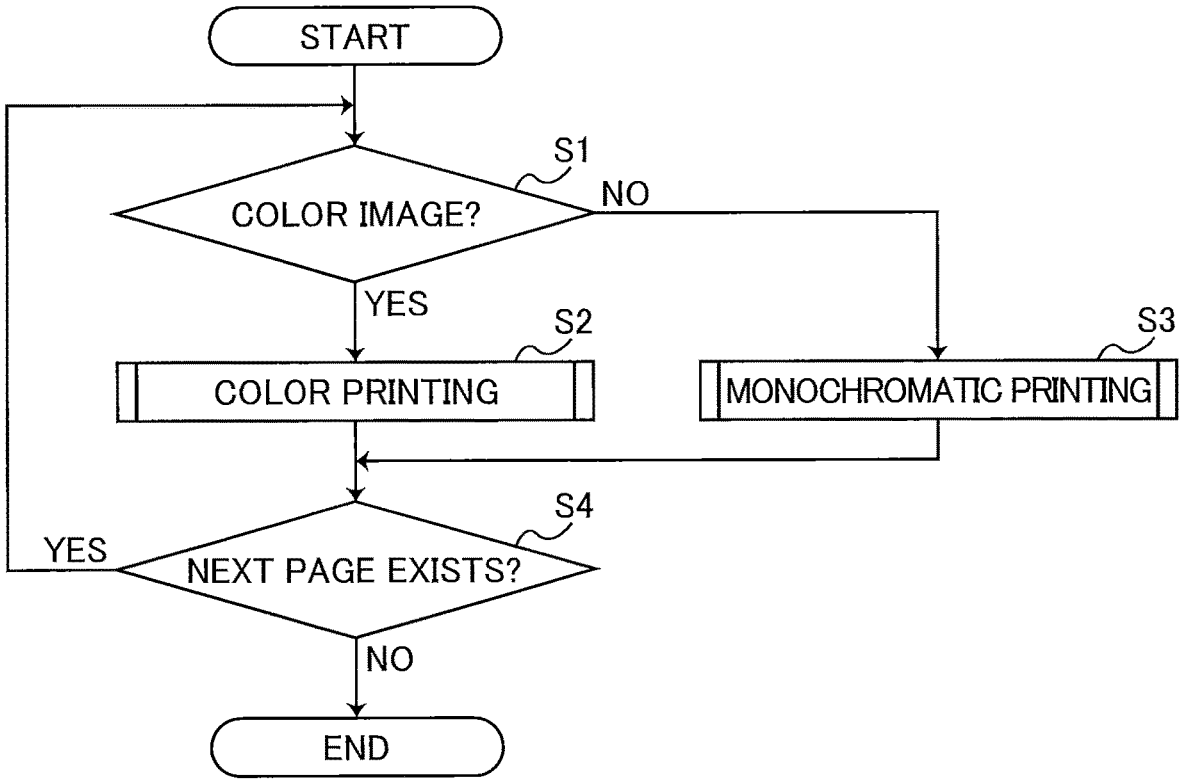
FIG. 16 is a flowchart illustrating an example of processing upon receipt of a print job in the image-forming apparatus according to the embodiment.

As illustrated in FIG. 16, in response to receipt of a print job, the controller 2 determines whether the image to be printed on a first page is a color image (S1). In a case where the color image is to be formed (S1: Yes), the routine proceeds to S2 to execute a color printing process. On the other hand, in a case where the image to be formed is a monochromatic image (S1: No), the routine proceeds to S3 to execute a monochromatic printing process. Upon completion of image formation on the first page in the step S2 or S3, the controller 2 determines whether the print job contains data of a subsequent page (S4). In a case where printing on the next page is required (S4: Yes), the routine returns back to the step S1, and in a case where the print job does not contain data of the next page (S4: No), the processing is terminated.

Figure 17:
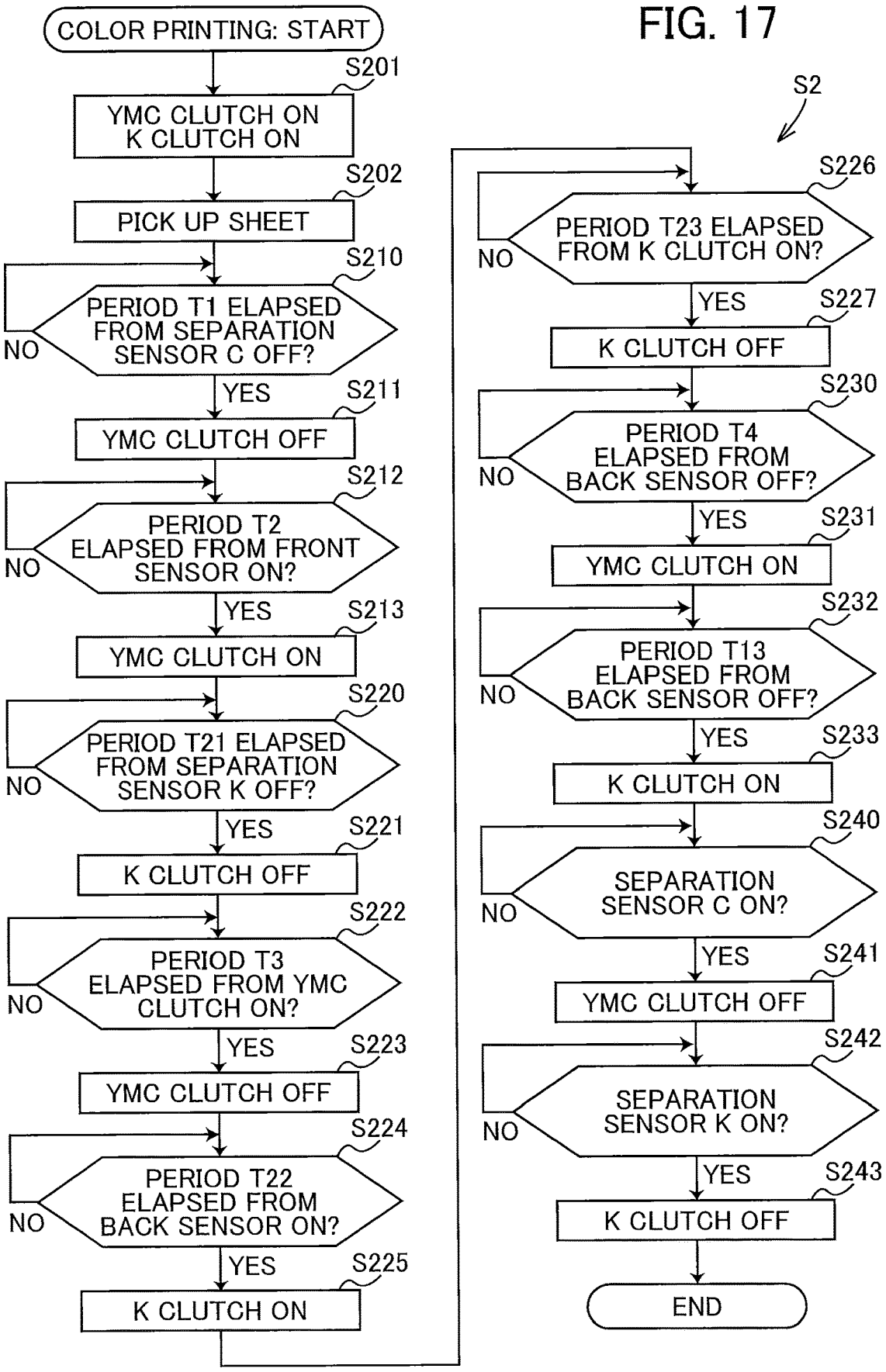
FIG. 17 is a flowchart illustrating processing for performing a color printing in the image-forming apparatus according to the embodiment.
Figure 18:
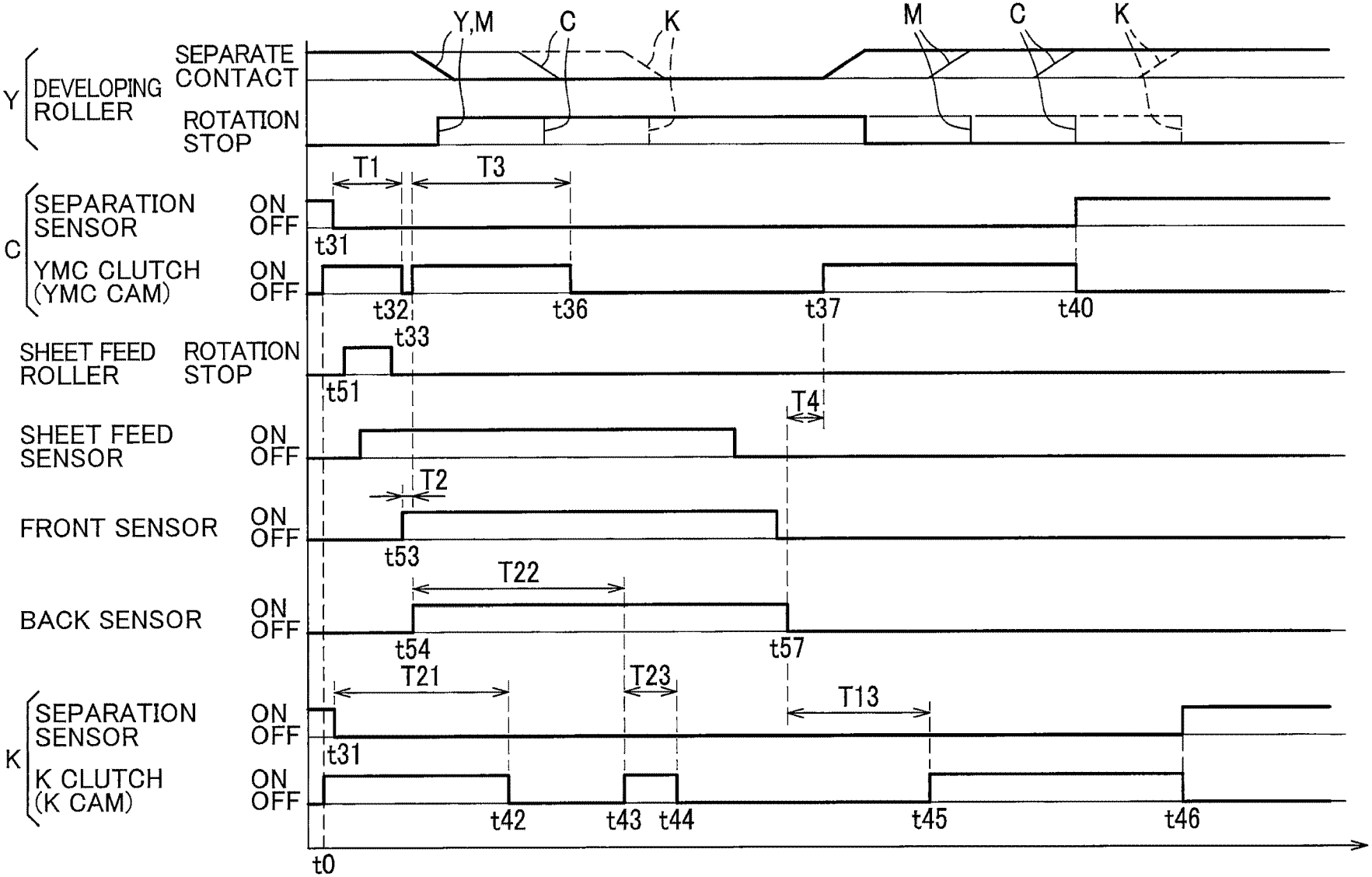
FIG. 18 is a timing chart for description of control to the YMC clutch and K clutch in response to output from each sensor for performing color printing in the image-forming apparatus according to the embodiment.

Next, the color printing process (to be performed in the step S2 of FIG. 16) will be described with reference to a flowchart of FIG. 17 and a timing chart of FIG. 18. Incidentally, each of FIGS. 17 and 18 illustrates a process for printing on a first page. Further, in the uppermost section in FIG. 18, operation timing of the first developing roller 61Y for the color of yellow is indicated by a bold line, and operation timing of the second through fourth developing rollers 61M, 61C and 61K for the colors of magenta, cyan and black are respectively indicated by normal lines and a broken line those being partly overlapped with the bold line.

In a case of processing the color printing in the step S2, all developing rollers 61 are at their separated positions prior to image forming operation. In order to successively move the developing rollers 61 to the contact positions, the controller 2 controls the YMC clutch 140A to be turned ON (S201, t0) and permits the K clutch 140K to be turned ON (S202, t0). As a result, the cams 150Y, 150M, 150C and 150K start rotating, and immediately thereafter, the separation sensors 4C and 4K are turned OFF (t31). The controller 2 then moves the sheet feed roller 23 for a prescribed period (at t51) for picking up the sheet S to start conveying the sheet S (S202).

After starting the sheet conveyance, the controller 2 determines in S210 whether the first time period T1 has elapsed from the timing (t31) at which the separation sensor 4C for the color of cyan outputs the OFF signal during a period from the start of the sheet conveyance until the arrival of the sheet S at the first photosensitive drum 50Y. In a case where the first time period T1 is determined to be elapsed (S210: Yes), the controller 2 controls the YMC clutch 140A to be turned OFF (S211, t32) to stop rotations of the cams 150Y, 150M and 150C at the temporary stop timing. The first time period T1 is so set that, at the temporary stop timing, the contact portion 172 of the cam follower 170 for the color of yellow is positioned on a region of the second holding surface F2, the region being closest to the second guide surface F4 (see FIG. 15B). Hence, immediately after the restart of rotations of the cams 150Y, 150M and 150C, the cam follower 170 for the color of yellow is moved onto the second guide surface F4, so that the first developing roller 61Y starts moving to the contact position.

Then, the controller 2 determines in S212 whether the second time period T2 has elapsed from a timing (t53) at which the front sensor 28B is turned ON (at which the leading edge of the sheet S moves past the front sensor 28B). In a case where the second time period T2 has elapsed (S212: Yes), the controller 2 permits the YMC clutch 140A to be turned ON (S213) to restart rotations of the cam 150Y, 150M and 150C at the restart timing (t33). The second time period T2 is so set that the toner development on the first photosensitive drum 50Y by the first developing roller 61Y can be completed by the time when the toner image is transferred from the photosensitive drum 50Y to the conveyed sheet S.

Further, the controller 2 determines in S220 whether a first time period T21 is elapsed from the timing (t31) at which the separation sensor 4K for the color of black outputs the OFF signal during a period from the start of conveyance of the sheet S until arrival of the sheet S at the fourth photosensitive drum 50K. In a case where the first time period T21 is elapsed (S220: Yes), the controller 2 turns the K clutch 140K OFF (S221) to stop rotation of the cam 150K at the temporary stop timing (t42).

The first time period T21 is set so that, at the temporary stop timing, the contact portion 172 of the cam follower 170 for the color of black is positioned on a region of the second holding surface F2, the region being closest to the second guide surface F4 (see FIG. 15B). Hence, immediately after the restart of rotation of the cam 150K, the cam follower 170 for the color of black is moved to the second guide surface F4, so that the fourth developing roller 61K starts moving to the contact position. Incidentally, the first time period T21 is different from the first time period T1.

Then, the controller 2 determines in S222 whether a third time period T3 has elapsed from the restart timing (t33) at which the YMC clutch 140A is turned ON. In a case where the third time period T3 has elapsed (S222: Yes), the controller 2 permits the YMC clutch 140A to be turned OFF (S223, t36) to stop rotations of the cams 150Y, 150M and 150C.

The third time period T3 is set to such a period of time within which: the first developing roller 61Y, the second developing roller 61M, and the third developing roller 61C all move to the contact positions; and the contact portion 172 associated with the yellow cam follower 170 is in contact with the first guide surface F3 at a position adjacent to the first holding surface F1. Hence, upon restart of rotations of the cams 150Y, 150M and 150C, the cam follower 170 associated with the color of yellow promptly moves along the first guide surface F3 toward the second holding surface F2 so that the first developing roller 61Y promptly starts moving toward the separated position. Then, the controller 2 determines in S224 whether a second time period T22 has elapsed from a timing (t54) at which the back sensor 28C is turned ON (at which the leading edge of the sheet S moves past the back sensor 28C). In a case where the second time period T22 is elapsed (S224: Yes), the controller 2 permits the K clutch 140K to turn ON (S225) to start rotation of the cam 150K at a timing t43. The second time period T22 is so set that the toner development on the fourth photosensitive drum 50K by the fourth developing roller 61K can be completed by the time when the toner image is transferred from the photosensitive drum 50K to the conveyed sheet S. Hence, the fourth developing roller 61K can move to the contact position at a timing immediately before exposure to the third photosensitive drum 50C is started.

Next, the controller 2 determines in S226 whether a predetermined time period T23 has elapsed from the turning ON timing (t43) of the K clutch 140K. In a case where the predetermined time period T23 is elapsed (S226: Yes), the controller 2 permits the K clutch 140K to turn OFF (S227, t44) to stop rotation of the cam 150K. The predetermined time period T23 is set to such a period of time within which the fourth developing roller 61K moves to the contact position.

Then, the controller 2 determines in S230 whether a fourth time period T4 has elapsed from a timing (t57) at which the back sensor 28C turns OFF (at which the trailing edge of the sheet S moves past the back sensor 28C). In a case where the fourth time period T4 has elapsed (S230: Yes), the controller 2 permits the YMC clutch 140A to turn ON (S231, t37) to rotate the cams 150Y, 150M and 150C, to thus successively start separation of the first developing roller 61Y, the second developing roller 61M, and the third developing roller 61C from the respective photosensitive drums 50Y, 50M and 50C.

The fourth time period T4 is set to such a period of time within which the first developing roller 61Y can move to the separated position after the completion of development on the first photosensitive drum 50Y by the first developing roller 61Y and immediately after the completion of image transfer from the first photosensitive drum 50Y to the sheet S.

The controller 2 then determines in S232 whether a predetermined time period T13 has elapsed from the OFF timing (t57) of the back sensor 28C. In a case where the predetermined time period T13 has elapsed (S232: Yes), the controller 2 permits the K clutch 140K to turn ON (S233, t45) to rotate the cam 150K. The predetermined time period T14 is set to such a period of time within which the fourth developing roller 61K can be moved to the separated position after completion of development on the fourth photosensitive drum 50K by the fourth developing roller 61K and immediately after the completion of image transfer from the fourth photosensitive drum 50K to the sheet S.

Then, the controller 2 determines in S240 whether the separation sensor 4C for the color of cyan outputs the ON signal (separation signal). In a case where the ON signal is outputted (S240: Yes), the controller 2 controls the YMC clutch 140A to be turned OFF (S241, t40) to stop rotations of the cams 150Y, 150M and 150C.

The controller 2 then determines in S242 whether the separation sensor 4K for the color of black outputs the ON signal. In a case where the ON signal is outputted (S242: Yes), the controller 2 permits the K clutch 140K to turn OFF (S243, t46) to stop rotation of the cam 150K.

Figure 19:
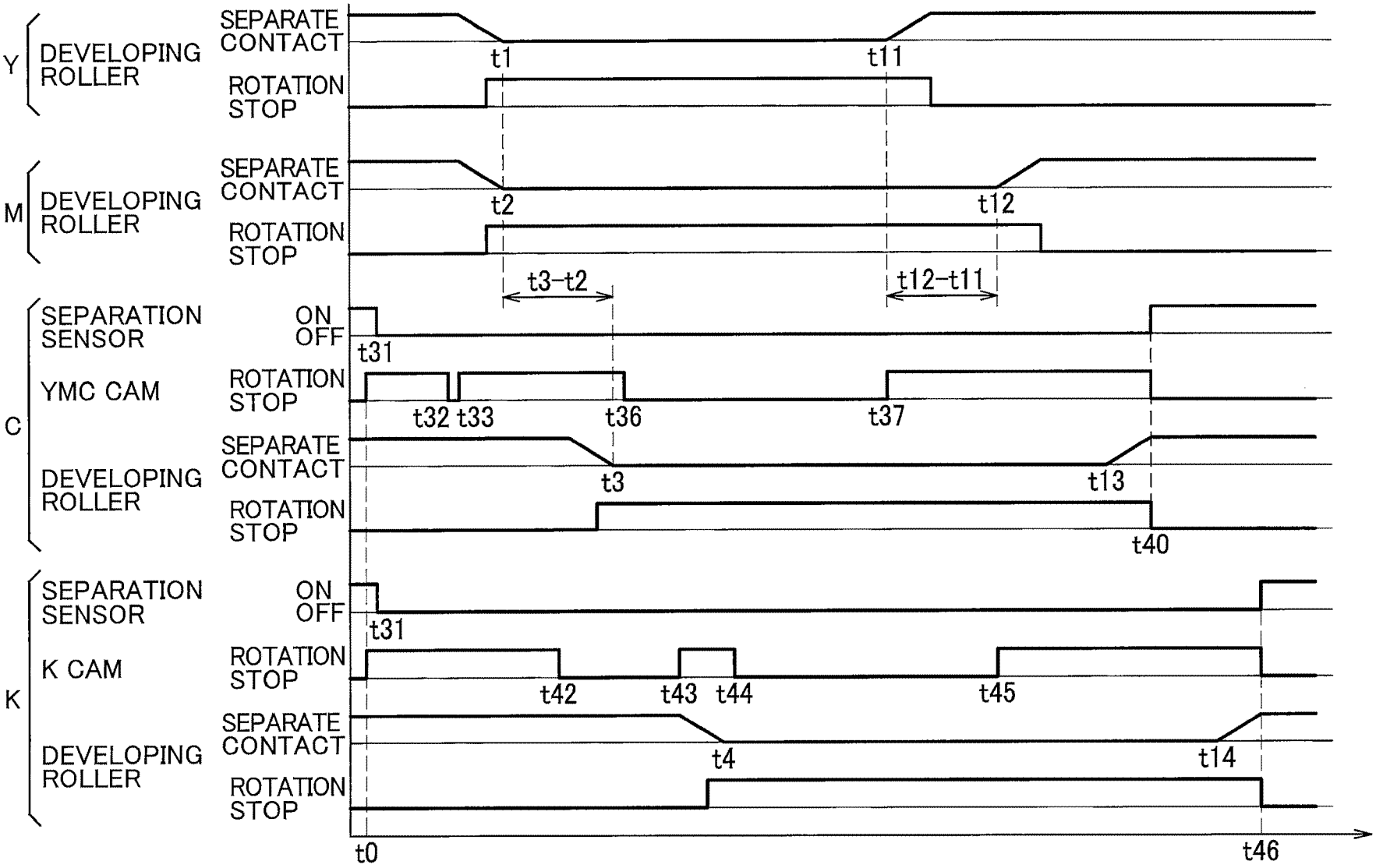
FIG. 19 is a timing chart for description of operations of the cam, separation sensors, and developing rollers of respective colors for performing color printing in the image-forming apparatus according to the embodiment.

In this way, the developing rollers 61 are sequentially moved from the separated positions to the contact positions, and then from the contact positions to the separated positions after completion of printing on each sheet S. Specifically, as illustrated in FIG. 19, the first developing roller 61Y is brought into contact with the first photosensitive drum 50Y at the time t1; the second developing roller 61M is brought into contact with the second photosensitive drum 50M at the time t2; the third developing roller 61C is brought into contact with the third photosensitive drum 50C at a time t3; and the fourth developing roller 61K is brought into contact with the fourth photosensitive drum 50K at a time t4.

In the depicted embodiment, the following expressions are satisfied: $t1=t2$, $t1<t3$, $t2<t3$, and $t3<t4$. Also, a relationship $|t1-t2|<|t2-t3|$ is met, provided that $|t1-t2|$ denotes a time period from the time t1 to the time t2 and $|t2-t3|$ denotes a time period from the time t2 to the time t3. Incidentally, a value of later time is greater than a value of earlier time; a value obtained by subtracting the earlier time from the later time is a positive value; and a value obtained by subtracting the later time from the earlier time is a negative value. An absolute value obtained by subtracting a time from a time implies a length of time. With respect to the relationship between the time t1 and the time t2, t2 may be earlier than t1 ($t2<t1$). In the latter case, $t2-t1$ becomes a negative value. In a case where the time t2 is earlier than the time t1, the second developing roller 61M is moved to the contact position at an earlier timing than otherwise.

Further, in the image-forming apparatus 1, the first developing roller 61Y is separated from the first photosensitive drum 50Y at a time t11; the second developing roller 61M is separated from the second photosensitive drum 50M at a time t12; the third developing roller 61C is separated from the third photosensitive drum 50C at a time t13; and the fourth developing roller 61K is separated from the fourth photosensitive drum 50K at a time t14.

In the depicted embodiment, a relationship $t11<t12<t13<t14$ is satisfied. Here, a relationship $|t1-t2|<|t11-t12|$ is met, in which $|t1-t2|$ represents the time period from the time t1 to the time t2 and $|t11-t12|$ represents a time period from the time t11 to the time t12.

Figure 20:
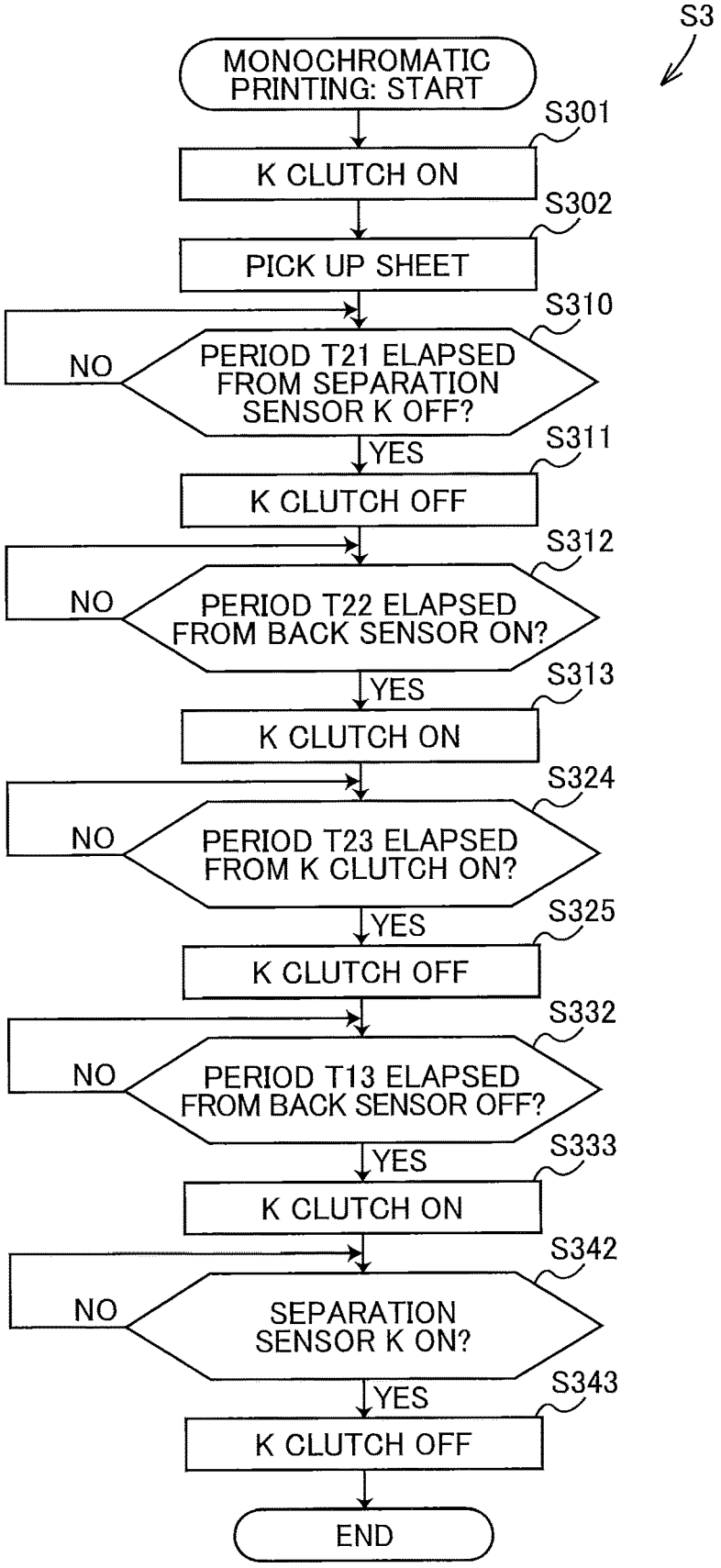
FIG. 20 is a flowchart for description of a monochromatic printing process in the image-forming apparatus according to the embodiment.
Figure 21:
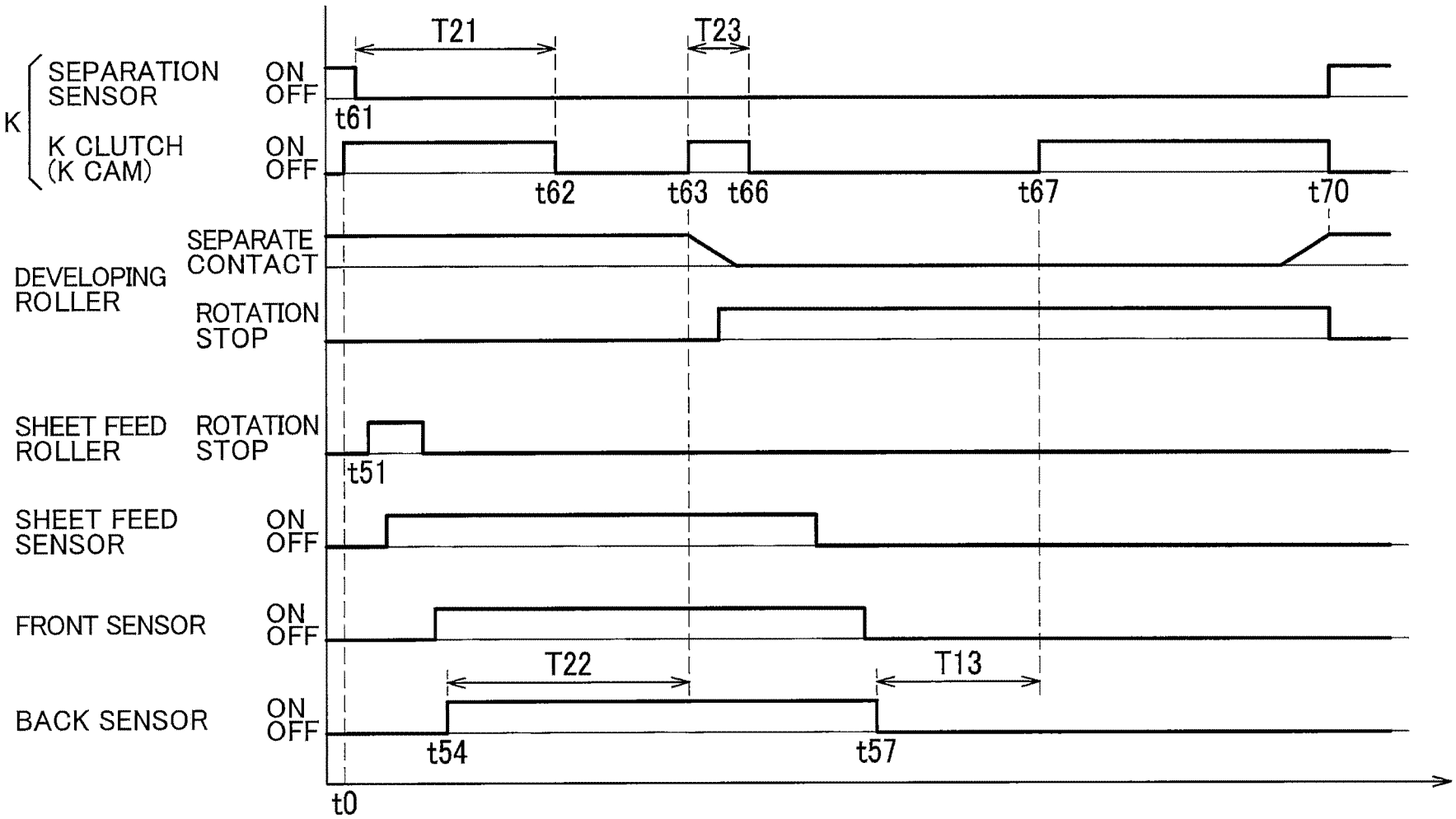
FIG. 21 is a timing chart for description of control to the K clutch in response to output from each sensor and the operation of the developing roller for the black color for performing monochromatic printing in the image-forming apparatus according to the embodiment.

Next, the monochromatic printing process (to be performed in the step S3 of FIG. 16) will be described with reference to a flowchart of FIG. 20 and a timing chart of FIG. 21. FIGS. 20 and 21 illustrate a printing process on a single sheet S.

For processing the monochromatic printing in the step S3 of FIG. 16, all developing rollers 61 are at their separated positions prior to image forming operation. During the monochromatic printing process, the controller 2 does not permit the YMC clutch 140A to rotate, and maintains the first developing roller 61Y, the second developing roller 61M and the third developing roller 61C intact at the respective separated positions. On the other hand, the controller 2 permits the K clutch 140K to turn ON (S301, t0) to cause the cam 150K to rotate for moving the fourth developing roller 61K to the contact position. Immediately after the rotation of the cam 150K, the separation sensor 4K for the color of black is turned OFF (t61). The controller 2 controls the sheet feed roller 23 to rotate (t51) for a predetermined period of time so as to pick up and start conveying the sheet S (S302).

Then, the controller 2 determines in S310 whether the first time period T21 has elapsed from the timing (t61) at which the separation sensor 4K for the color of black outputs the OFF signal after starting the conveyance of the sheet S and prior to arrival of the sheet S at the fourth photosensitive drum 50K. In a case where the first time period T21 has elapsed (S310: Yes), the controller 2 permits the K clutch 140K to turn OFF (S311, t62) to stop rotation of the cam 150K at the temporary stop timing.

The first time period T21 is so set that, at the temporary stop timing, the contact portion 172 of the cam follower 170 for the color of black is positioned on a region of the second holding surface F2 of the cam 150K, the region being closest to the second guide surface F4 (see FIG. 15B). Hence, immediately after the restart of rotation of the cams 150K, the cam follower 170 for the color of black can move to the second guide surface F4 to allow the fourth developing roller 61K to start moving to the contact position. Incidentally, the first time period T21 in the monochromatic printing is different from the first time period T1 in the color printing.

Then, the controller 2 determines in S312 whether the second time period T22 has elapsed from the timing (t54) at which the back sensor 28C is turned ON (at which the leading edge of the sheet S moves past the back sensor 28C). In a case where the second time period T22 has elapsed (S312: Yes), the controller 2 permits the K clutch 140K to turn ON (S313) to resume rotation of the cam 150K at the restart timing (t63). The second time period T22 is so set that the toner development on the fourth photosensitive drum 50K by the fourth developing roller 61K can be completed by the time when the toner image is transferred from the photosensitive drum 50K to the conveyed sheet S. Incidentally, the second time period T22 in the monochromatic printing is different from the second time period T2 in the color printing.

The controller 2 then determines in S324 whether the predetermined time period T23 has elapsed from the turning ON timing (t63) of the K clutch 140K. In a case where the predetermined time period T23 has elapsed (S324: Yes), the controller 2 permits the K clutch 140K to turn OFF (S325, t66) to stop rotation of the cam 150K. The predetermined time period T23 is set to such a period of time within which the fourth developing roller 61K is positioned at the contact position.

Then, the controller 2 determines in S332 whether the predetermined time period T13 has elapsed from the turning OFF timing (t57) of the back sensor 28C. In a case where the fourth time period is elapsed (S332: Yes), the controller 2 permits the K clutch 140K to turn ON (S333, t67) to start rotation of the cam 150K.

Next, the controller 2 determines in S342 whether the separation sensor 4K for the color of black outputs the ON signal. In a case where the ON signal is outputted (S342: Yes), the controller 2 permits the K clutch 140K to turn OFF (S343, t70) to stop rotation of the cam 150K.

In this way, for printing on the single sheet S, the fourth developing roller 61K is moved from the separated position to the contact position, and is then moved from the contact position to the separated position after completion of the printing. Throughout the operation, the first developing roller 61Y, the second developing roller 61M, and the third developing roller 61C are held at the respective separated positions. Hence, idle rotation of these developing rollers 16 can be prevented.

<Operations of the Developing Rollers 61 in Relation to Conveyance of the Sheet S>

Figure 22A:
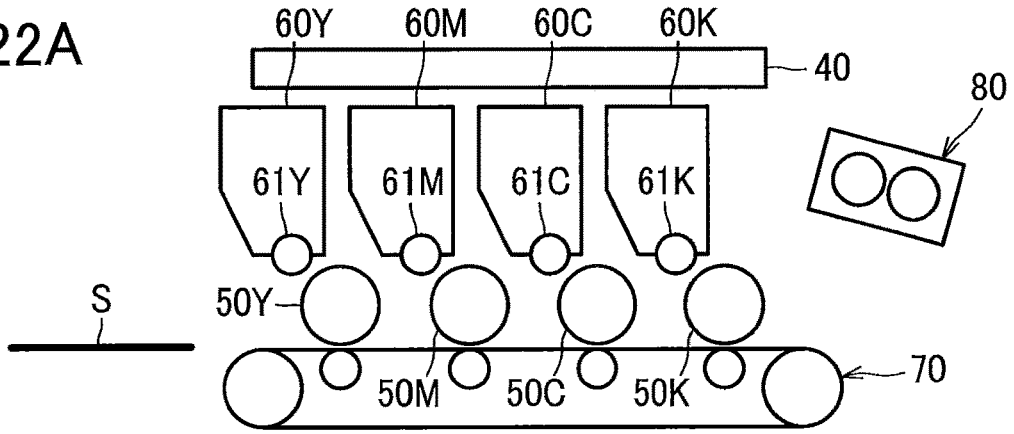
FIG. 22A is a view for description of contacting/separating operations of the developing rollers for performing color printing in a state where a sheet is approaching the most upstream photosensitive drum in the image-forming apparatus according to the embodiment.

Next, operations of the developing rollers 61 in relation to the movement of the sheet S according to the above-described embodiment will be described with reference to FIGS. 22A through 24C. In the image-forming apparatus 1, for performing color printing employing the first developing roller 61Y, the second developing roller 61M, the third developing roller 61C, and the fourth developing roller 61K, these developing rollers 61 are configured to be moved to the respective contact positions to transfer respective toner images to the sheet S, and moved to the respective separated positions after termination of the development of the toner images onto the corresponding photosensitive drums 50 in timed relation to the movement of the sheet S. Specifically, as illustrated in FIG. 22A, the first developing roller 61Y, the second developing roller 61M, the third developing roller 61C, and the fourth developing roller 61K are set at the respective separated positions prior to arrival of the sheet S at the most upstream first photosensitive drum 50Y. In the state where all the developing rollers 61 are at the separated positions, the second developing cartridge 60M is overlapped with the path of the laser beam for exposing the first photosensitive drum 50Y; the third developing cartridge 60C is overlapped with the path of the laser beam for exposing the second photosensitive drum 50M; and the fourth developing cartridge 60K is overlapped with the path of the laser beam for exposing the third photosensitive drum 50C (see FIG. 1).

Figure 22B:
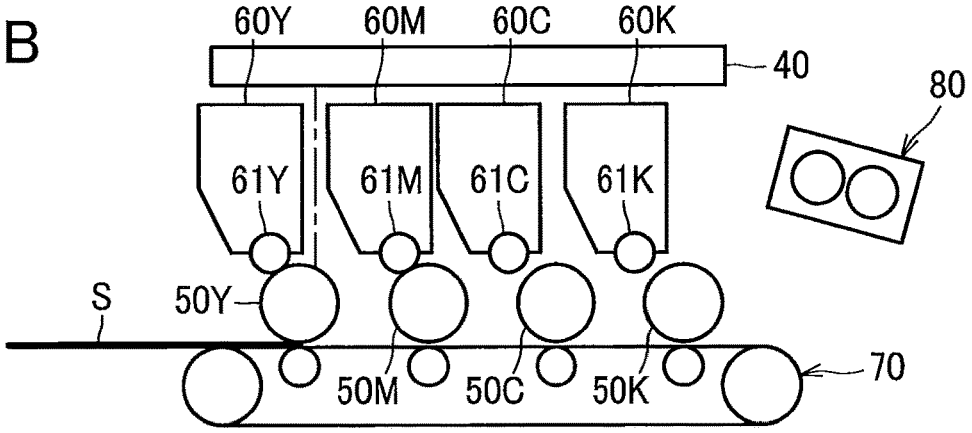
FIG. 22B is a view for description of contacting/separating operations of the developing rollers for performing color printing in a state where the sheet is about to reach the most upstream photosensitive drum.

Then, as illustrated in FIG. 22B, when the sheet S is about to arrive at the first photosensitive drum 50Y, the first developing cartridge 60Y and the second developing cartridge 60M are simultaneously moved to move the corresponding developing rollers 61 (61Y and 61M) to the respective contact positions prior to start of the exposure of the first photosensitive drum 50Y. Hence, the second developing cartridge 60M does not become an obstacle against the path of the laser beam for exposing the first photosensitive drum 50Y, thereby enabling laser beam irradiation to the first photosensitive drum 50Y. Therefore, development of a toner image on the first photosensitive drum 50Y by the first developing roller 61Y can be performed, and the toner image can be transferred to the sheet S.

Figure 22C:
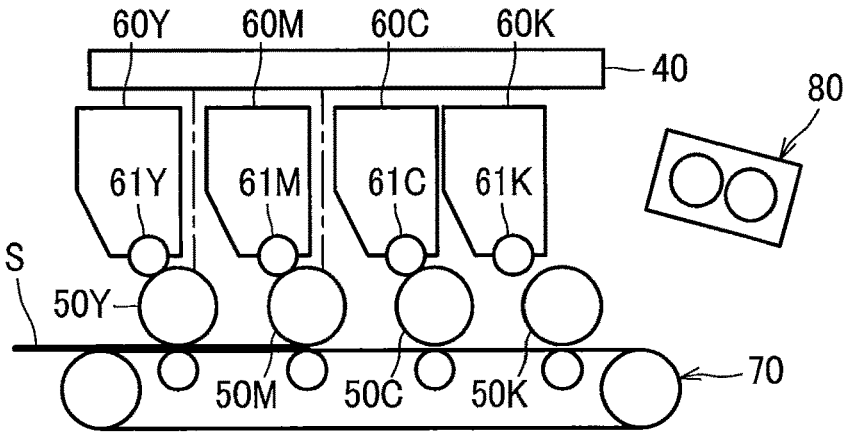
FIG. 22C is a view for description of contacting/separating operations of the developing rollers for performing color printing in a state where the sheet is about to reach a second photosensitive drum immediately downstream of the most upstream photosensitive drum.

Then, as illustrated in FIG. 22C, when the sheet S is about to arrive at the second photosensitive drum 50M, the third developing cartridge 60C is moved to move the developing roller 61C to the contact position prior to start of the exposure of the second photosensitive drum 50M to the laser beam. Hence, the third developing cartridge 60C does not become an obstacle against the path of the laser beam toward the second photosensitive drum 50M, thereby enabling laser beam irradiation to the second photosensitive drum 50M. Therefore, development of a toner image on the second photosensitive drum 50M by the second developing roller 61M can be performed, and the toner image can be transferred to the sheet S.

Figure 22D:
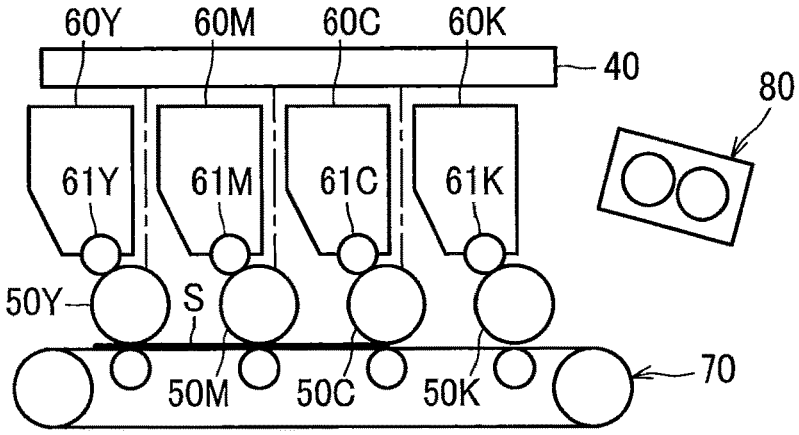
FIG. 22D is a view for description of contacting/separating operations of the developing rollers for performing color printing in a state where the sheet is about to reach a third photosensitive drum immediately downstream of the second photosensitive drum.

Then, as illustrated in FIG. 22D, when the sheet S is about to arrive at the third photosensitive drum 50C, the fourth developing cartridge 60K is moved to move the fourth developing roller 61K to the contact position prior to start of the exposure of the third photosensitive drum 50C to the laser beam. Hence, the fourth developing cartridge 60K does not become an obstacle against the path of the laser beam toward the third photosensitive drum 50C, thereby enabling laser beam irradiation to the third photosensitive drum 50C. Therefore, development of a toner image on the third photosensitive drum 50C by the third developing roller 61C can be performed, and the toner image can be transferred to the sheet S. Further, the development of a toner image on the fourth photosensitive drum 50K by the fourth developing roller 61K can be performed subsequently, since the fourth developing roller 61K is already at the contact position.

Figure 23A:
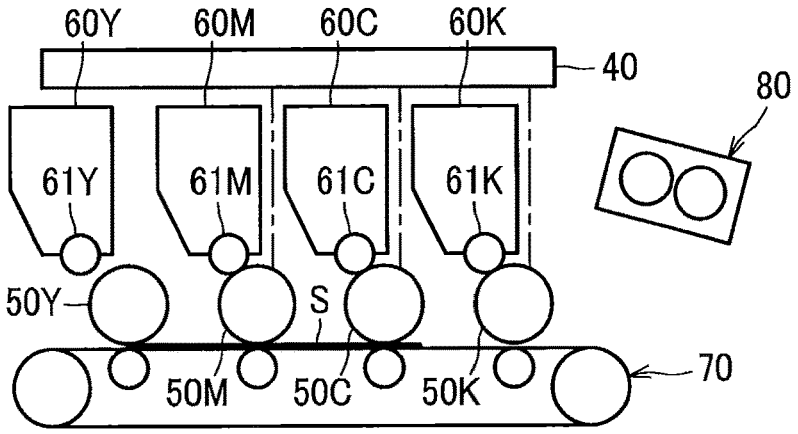
FIG. 23A is a view for description of contacting/separating operations of the developing rollers for performing color printing in a state subsequent to the state of FIG. 22D.

Then, as illustrated in FIG. 23A, the first developing cartridge 60Y is moved for moving the first developing roller 61Y to the separated position, after termination of the development on the photosensitive drum 50Y by the first developing roller 61Y and prior to termination of the development on the photosensitive drum 50M by the second developing roller 61M.

Figure 23B:
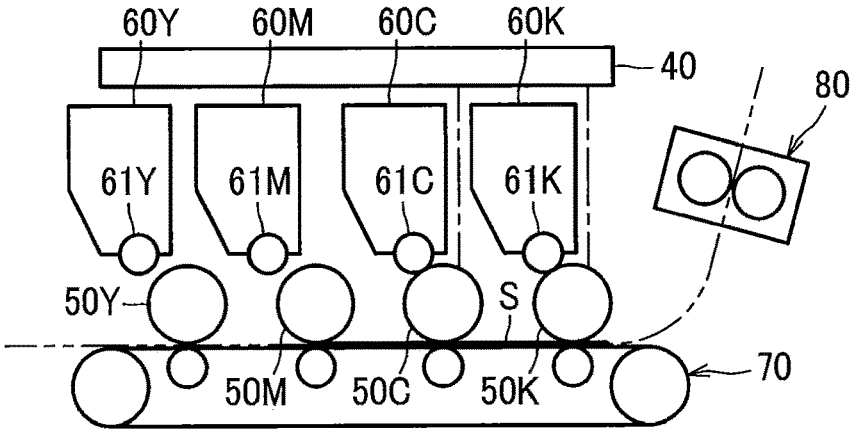
FIG. 23B is a view for description of contacting/separating operations of the developing rollers for performing color printing in a state subsequent to the state of FIG. 23A.

Then, as illustrated in FIG. 23B, the second developing cartridge 60M is moved for moving the second developing roller 61M to the separated position, after the termination of the development on the photosensitive drum 50M by the second developing roller 61M and prior to termination of the development on the photosensitive drum 50C by the third developing roller 61C.

Figure 23C:
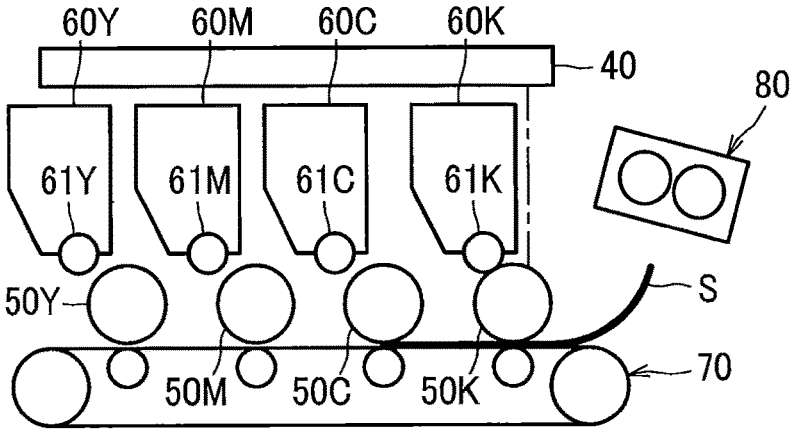
FIG. 23C is a view for description of contacting/separating operations of the developing rollers for performing color printing in a state subsequent to the state of FIG. 23B.

Then, as illustrated in FIG. 23C, the third developing cartridge 60C is moved for moving the third developing roller 61C to the separated position, after termination of the development on the photosensitive drum 50C by the third developing roller 61C and prior to termination of the development on the photosensitive drum 50K by the fourth developing roller 61K.

Figure 23D:
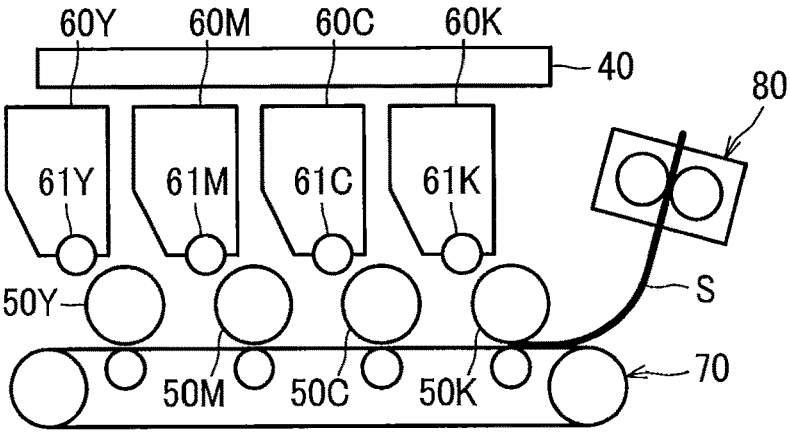
FIG. 23D is a view for description of contacting/separating operations of the developing rollers for performing color printing in a state subsequent to the state of FIG. 23C.

Then, as illustrated in FIG. 23D, the fourth developing cartridge 60K is moved for moving the fourth developing roller 61K to the separated position, after termination of the development on the photosensitive drum 50K by the fourth developing roller 61K.

Figure 24A:
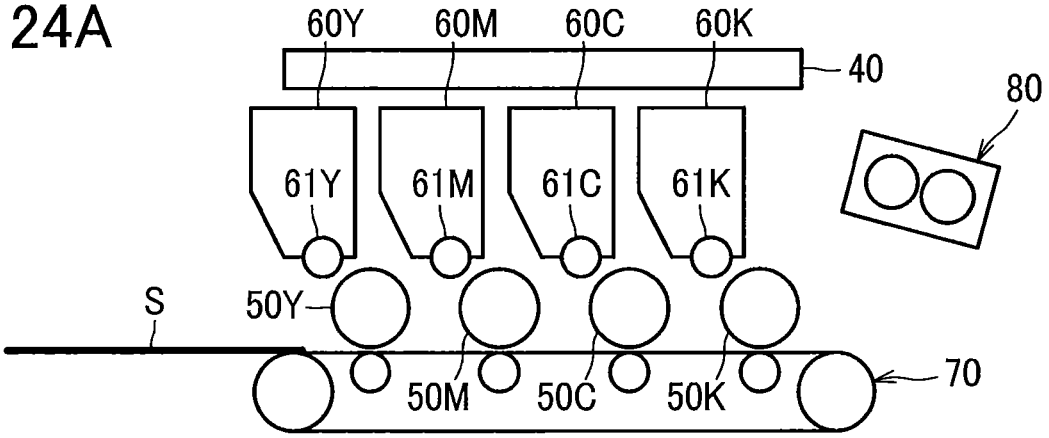
FIG. 24A is a view for description of contacting/separating operations of the developing rollers for performing monochromatic printing in a state where the sheet is approaching to the most upstream photosensitive drum.
Figure 24B:
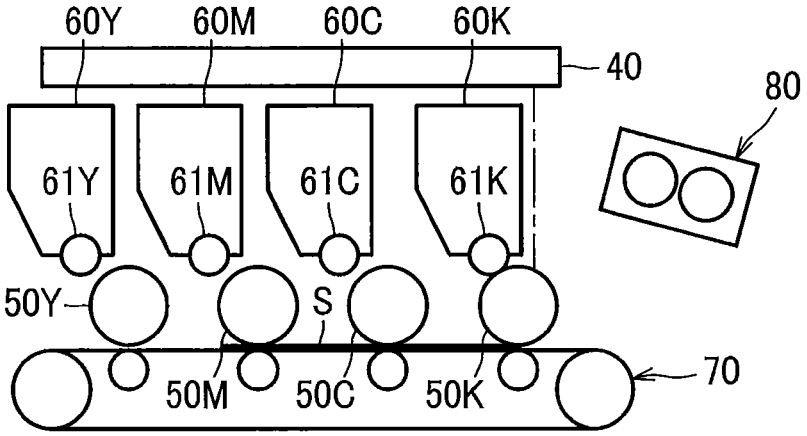
FIG. 24B is a view for description of contacting/separating operations of the developing rollers for performing monochromatic printing in a state where the sheet is about to reach a fourth photosensitive drum immediately downstream of the third photosensitive drum.
Figure 24C:
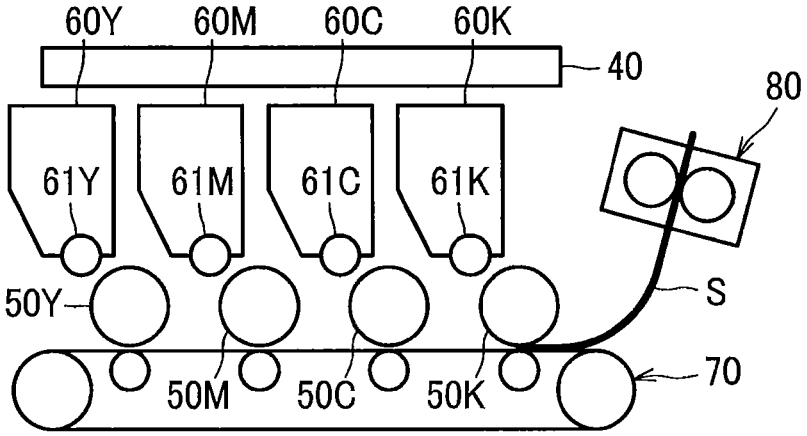
FIG. 24C is a view for description of contacting/separating operations of the developing rollers for performing monochromatic printing in a state where the sheet moves past the fourth photosensitive drum.

On the other hand, for performing monochromatic printing employing only the fourth developing roller 61K in the image-forming apparatus 1, as illustrated in FIG. 24A through FIG. 24C, the first developing roller 61Y, the second developing roller 61M and the third developing roller 61C for the colors of yellow, magenta and cyan other than black are maintained at the respective separated positions during transfer of a toner image to the sheet S. The fourth developing roller 61K for the color of black is moved to the contact position, and then moved to the separated position after termination of the development of the toner image on the fourth photosensitive drum 50K by the fourth developing roller 61K in timed relation to the movement of the sheet S.

Specifically, as illustrated in FIG. 24A, all the developing rollers 61 (61Y, 61M, 61C, and 61K) are at the separated positions when the sheet S approaches the first photosensitive drum 50Y. Then, as illustrated in FIG. 24B, the fourth developing cartridge 60K is moved for moving the fourth developing roller 61K to the contact position prior to start of the exposure of the fourth photosensitive drum 50K to the laser beam. Then, as illustrated in FIG. 24C, the fourth developing cartridge 60K is moved for moving the fourth developing roller 61K to the separated position after termination of the development on the fourth photosensitive drum 50K by the fourth developing roller 61K.

The image-forming apparatus 1 of the present embodiment constructed as above exhibits advantageous functions and effects as described below.

In the image-forming apparatus 1, the time period $|t1-t2|$ is shorter than the time period $|t2-t3|$ in which: the time t3 (at which the third developing roller 61C contacts the third photosensitive drum 50C) is later than the time t2 (at which the second developing roller 61M contacts the second photosensitive drum 50M); and the time t2 is coincident with the time t1 (at which the first developing roller 61Y contacts the first photosensitive drum 50Y).

That is, successive movement of the developing rollers 61Y, 61M and 61C for the first through third colors to contact with the corresponding photosensitive drums 50Y, 50M and 50C does not occur at a constant time interval. Rather, the first developing roller 61Y contacts the first photosensitive drum 50Y at a first timing as late as possible but capable of timely performing toner image development on the first photosensitive drum 50Y, whereas the second developing roller 61M contacts the second photosensitive drum 50M at a second timing earlier than the timing at which the toner image development on the second photosensitive drum 50M is started. Further, movement of the second developing cartridge 60M to move the second developing roller 61M to the contact position is terminated by the second timing, so that the second developing cartridge 60M does not overlap with the path of the laser beam for exposing the first photosensitive drum 50Y.

Hence, the second developing cartridge 60M can be enlarged in size to such an extent that the second developing cartridge 60M is overlapped with the path of the laser beam for exposure of the first photosensitive drum 50Y while the second developing roller 61M is at the separated position. In other words, according to the embodiment, an improved degree of freedom in terms of shape of the developing cartridge 60 can be obtained to increase capacity of toner with a minimum contacting period between the developing roller 61 and the photosensitive drum 50.

Further, in the image-forming apparatus 1 according to the embodiment, the relationship $|t1-t2|<|t11-t12|$ is satisfied, in which: t11 represents the timing of separation of the first developing roller 61Y from the first photosensitive drum 50Y; and t12 represents the timing of separation of the second developing roller 61M from the second photosensitive drum 50M; the time t11 is later than the time t2; and the time t12 is later than the time t11. Therefore, each developing roller 61 can be promptly separated from the corresponding photosensitive drum 50 as soon as termination of the exposure and image development in each color. Consequently, the time period during which the developing roller 61 and the photosensitive drum 50 are in contact with each other can be minimized.

Further, in the image-forming apparatus 1 according to the above-described embodiment, the relationship $t2 \leq t1$ is met, and the relationship $|t1-t2|<|t11-t12|$ is also met. With such a structure, the first developing roller 61Y contacts the first photosensitive drum 50Y at a timing as late as possible but capable of performing toner image development on the first photosensitive drum 50Y in time, whereas the second developing roller 61M contacts the second photosensitive drum 50M at a timing earlier than the timing of start of the toner image development on the second photosensitive drum 50M and earlier than the timing of exposure of the first photosensitive drum 50Y to the laser beam.

Further, in a case of monochromatic printing in the image-forming apparatus 1 according to the above-described embodiment, only the fourth developing roller 61K for the color of black is configured to be moved so as to contact and separate from the fourth photosensitive drum 50K in timed relation to the movement of the sheet S, while the first developing roller 61Y, the second developing roller 61M, and the third developing roller 61C other than the fourth developing roller 61K are kept separated from the first photosensitive drum 50Y, the second photosensitive drum 50M, and the third photosensitive drum 50C, respectively.

With this configuration, a time period for contacting the first developing roller 61Y, the second developing roller 61M, and the third developing roller 61C other than the fourth developing roller 61K with the respective first photosensitive drum 50Y, the second photosensitive drum 50M, and the third photosensitive drum 50C can be minimized, thereby prolonging service life of the respective developing cartridges 60.

Further, in a case of color printing in the image-forming apparatus 1 according to the above-described embodiment, the controller 2 permits the cam 150Y to start rotating during a time period after starting sheet conveyance but prior to arrival of the sheet S at the first photosensitive drum 50Y; the controller 2 then permits the cam 150Y to temporarily stop rotation at the temporary stop timing upon elapse of the first time period T1 from the timing (t31) at which the separation signal from the separation sensor 4C is no longer acquired; and the controller 2 then permits the cam 150Y to restart rotation thereof (at t33) in accordance with the movement of the sheet S. Hence, the first developing roller 61Y can be brought into contact with the first photosensitive drum 50Y within a short period of time once the rotation is resumed. Consequently, waiting time for conveying the sheet S to the first photosensitive drum 50Y can be shortened.

Further, in the case of color printing in the image-forming apparatus 1, the controller 2 permits the cam 150K to start rotating after starting sheet conveyance and prior to arrival of the sheet S at the fourth photosensitive drum 50K, and then permits the cam 150K to temporarily stop rotating at the temporary stop timing upon elapse of the first time period T21 from the timing (t31) at which the separation signal from the separation sensor 4K is no longer acquired, and then permits the cam 150K to restart rotation (at t43) in accordance with the movement of the sheet S. Hence, the fourth developing roller 61K is brought into contact with the fourth photosensitive drum 50K within a short period of time after the rotation is restarted. Consequently, waiting time for conveying the sheet S to the fourth photosensitive drum 50K can be shortened.

Further, the phases of the cams 150Y and 150K largely vary when the separation signal is outputted, whereas the phases do not largely fluctuate when the separation signal is no longer acquired from the separation sensors 4C, 4K, i.e., at a transition timing from the state where the separation signal is outputted to the state where the separation signal is not outputted. Therefore, the rotations of the developing rollers 61Y and 61K are temporarily stopped immediately before the developing rollers 61Y and 61K respectively contact the photosensitive drums 50Y and 50K at the transition timing as a criteria timing. Consequently, variation in the phases of the cams 150Y and 150K at the temporary stop timing can be reduced.

The YMC clutch 140A is configured to be operated to start rotation of the cam 150Y at the restart timing upon elapse of the second time period T2 from the timing (t53) at which the front sensor 28B detects the leading edge of the sheet S after the temporary stop of the cam 150Y, in order to bring the first developing roller 61Y into contact with the first photosensitive drum 50Y to perform image formation. Hence, the first developing roller 61Y can be brought into contact with the first photosensitive drum 50Y in timed relation to the image formation on the sheet S.

The K clutch 140K is configured to be operated to start rotation of the cam 150K at the restart timing upon elapse of the second time period T22 from the timing at which the back sensor 28C detects the leading edge of the sheet S after the temporary stop of the cam 150K, so that the fourth developing roller 61K can be brought into contact with the fourth photosensitive drum 50K to perform image formation. Hence, the fourth developing roller 61K can be brought into contact with the fourth photosensitive drum 50K in timed relation to the image formation on the sheet S. That is, variation in phases of the cams 150Y and 150K at the temporary stop timing prior to the start of contact of the first developing roller 61Y and the fourth developing roller 61K with the corresponding photosensitive drums 50Y and 50K is reduced, so that a shortened period of contact between the first developing roller 61Y and the first photosensitive drum 50Y and between the fourth developing roller 61K and the fourth photosensitive drum 50K can be realized.

Further, the contacting timing between the second developing roller 61M and the second photosensitive drum 50M, contacting timing between the third developing roller 61C and the third photosensitive drum 50C, and contacting timing between the fourth developing roller 61K and the fourth photosensitive drum 50K are mechanically determined by the contacting timing between the first developing roller 61Y and the first photosensitive drum 50Y. Hence, the period of contacting the second developing roller 61M, the third developing roller 61C, and the fourth developing roller 61K with the corresponding photosensitive drums 50 can also be shortened. Further, in a case of monochromatic printing in the image-forming apparatus 1 according to the above-described embodiment, the controller 2 permits the cam 150K to start rotating after starting sheet conveyance and prior to arrival of the sheet S at the fourth photosensitive drum 50K, and then permits the cam 150K to temporarily stop rotation at the temporary stop timing upon elapse of the first time period T21 from the timing at which the separation signal from the separation sensor 4C is not any more acquired, and then permits the cam 150K to restart rotation in accordance with the movement of the sheet S. Hence, the fourth developing roller 61K is brought into contact with the fourth photosensitive drum 50K within a short period from the timing of restart of rotation. Consequently, waiting time for conveying the sheet S to the fourth photosensitive drum 50K can be shortened.

Further, the phase of the cam 150K largely varies when the separation signal is outputted, whereas the phase is not largely fluctuated when the separation signal is not any more acquired from the separation sensor 4K, that is, at the transition timing from the state of outputting the separation signal to the state of not outputting the separation signal. Therefore, rotation of the developing roller 61K is temporarily halted immediately before contacting the developing roller 61K with the fourth photosensitive drum 50K at the transition timing as a criteria timing. Consequently, variation of the phase of the cam 150K at the temporary stop timing can be reduced.

The K clutch 140K is configured to be operated to start rotation of the cam 150K at the restart timing upon elapse of the second time period T22 from the timing at which the front sensor 28B detects the leading edge of the sheet S after the temporary stop of the cam 150K, so that the fourth developing roller 61K is brought into contact with the fourth photosensitive drum 50K to perform image formation. Hence, the fourth developing roller 61K can be brought into contact with the fourth photosensitive drum 50K in timed relation to the image formation on the sheet S.

That is, variation in phase of the cam 150K at the temporary stop timing prior to the start of contact of the fourth developing roller 61K with the fourth photosensitive drum 50K is reduced, and a shortened period of contact between the fourth developing roller 61K and the fourth photosensitive drum 50K can be realized.

Further, in the image-forming apparatus 1 according to the above-described embodiment, the rotation of each developing roller 61 can be stopped by the clutch 120 while the developing roller 61 is at the separated position. Therefore, the number of rotations of the developing roller 61 can be reduced to restrain degradation of toner.

Further, in the image-forming apparatus 1 according to the above-described embodiment, the cam 150 is configured to be rotated in response to the signal from the back sensor 28C to move the developing roller 61 away from the corresponding photosensitive drum 50. Hence, the separation of the developing roller 61 can be started at an accurate timing.

Further, in the image-forming apparatus 1 according to the above-described embodiment, in a case of maintaining the developing rollers 61Y, 61M and 61C at the respective contact positions, the rotation of the yellow cam 150Y is stopped while the associated cam follower 170 is in contact with the first guide surface F3 (see FIG. 12B). Therefore, in accordance with the start of subsequent rotation of the cam 150Y, the associated cam follower 170 can be promptly moved from the standby position to the operating position by way of the sliding movement along the first guide surface F3. Consequently, the first developing roller 61Y can be promptly moved from the contact position to the separated position, so that the first developing roller 61Y can be promptly separated from the first photosensitive drum 50Y.

Further, in the image-forming apparatus 1 according to the above-described embodiment, the rotation of the cam 150Y is halted while the associated cam follower 170 is in contact with the first guide surface F3 at the position closer to the first holding surface F1 than to the second holding surface F2. Therefore, even if the cam 150Y may happen to angularly rotate by a small amount due to vibrations while the rotation of the cam 150Y is suspended, accidental displacement of the cam follower 170 to the second holding surface F2 can be obviated. Hence, the first developing roller 61Y can be stably in contact with the first photosensitive drum 50Y once the first developing roller 61Y is moved to the contact position and the rotation of the cam 150Y is stopped.

In particular, the image-forming apparatus 1 according to the above-described embodiment includes the springs 173 each for urging the corresponding cam follower 170 toward the cam surface 152F (toward the standby position). With this structure, the springs 173 can prevent the cam followers 170 from moving to the second holding surface F2 when the rotation of the cam 150Y is stopped. Therefore, the first developing roller 61Y can be securely in contact with the first photosensitive drum 50Y. Further, the springs 173 can avoid rattling of the cam followers 170.

Further, in the image-forming apparatus 1 according to the above-described embodiment, each cam follower 170 is separated from the slide member 64 provided in the corresponding developing cartridge 60 when the developing roller 61 is at the contact position. This structure can prevent the developing cartridge 60 from being applied with unwanted force from the corresponding cam follower 170 when the developing roller 61 is at the contact position. Hence, disadvantageous force application to the developing roller 61 can be avoided when the developing roller 61 is at the contact position.

Various modifications are conceivable.

For example, in the above-described embodiment, the tension spring 173 is used as an urging member for urging the cam follower 170 to the standby position. However, a compression spring or a spring other than a coil spring may be available as the urging member.

Further, in the above-described embodiment, the separation sensor 4C for the color of cyan is used as a phase sensor for indirectly detecting the phase (angular position) of the cam 150Y for the color of yellow. However, a separation sensor for directly detecting the phase of the cam 150Y may be provided. Further, in the above-described embodiment, the phase sensor (the separation sensor 4C) includes the light emitting portion 4P and the light receiving portion 4R. However, the phase sensor may have any other configuration as long as the sensor can detect the phase of the cam 150.

Further, in the above-described embodiment, for maintaining the contact position of the developing roller 61, the rotation of the cam 150Y is stopped while the associated cam follower 170 is in contact with the first guide surface F3 at the position closer to the first holding surface F1 than to the second holding surface F2. Regarding the cam 150K, the rotation of the cam 150K may be stopped in a manner similar to the cam 150Y. Further, the rotations of the cams 150M, 150C may also be stopped in a similar manner similar to the cam 150Y by suitably altering the contours of the respective cam surfaces 152F.

Further, according to the above-described embodiment, the front sensor 28BC is employed as a sheet sensor. However, the back sensor 28C or the sheet feed sensor 28A may be available as the sheet sensor.

Further, the image-forming apparatus 1 according to the above-described embodiment is a color printer using toners of four colors. However, the image-forming apparatus of the disclosure may be a color printer employing toners of three colors or five colors for forming color images. As a further modification, the image-forming apparatus may be a monochromatic printer provided with a single photosensitive drum, a single developing roller, and a single cam and using a toner of single color.

Still alternatively, a multifunction device and a copying machine are also available as the image-forming apparatus.

While the description has been made in detail with reference to the embodiments, it would be apparent to those skilled in the art that many modifications and variations may be made thereto.

REMARKS

In the depicted embodiment, the first photosensitive drum 50Y is an example of a photosensitive drum. The first developing roller 61Y is an example of a developing roller. The cam 150Y is an example of a cam. The cam follower 170 in association with the cam 150Y is an example of a cam follower. The YMC clutch 140A is an example of a switching mechanism. The first developing cartridge 60Y is an example of a developing cartridge. The spring 173 in association with the cam 150Y is an example of an urging member. The controller 2 is an example of a controller. The separation sensor 4C is an example of a phase sensor. The front sensor 28B is an example of a sheet sensor. The separation mechanism 5 is an example of a developing roller moving mechanism.

What is claimed is:

1. An image-forming apparatus comprising:

a photosensitive drum;

a developing roller rotatable about an axis extending in an axial direction and movable between a contact position in contact with the photosensitive drum and a separated position away from the photosensitive drum;

a cam rotatable in a prescribed rotational direction to move the developing roller between the contact position and the separated position, the cam having a cam surface comprising;

a first holding surface;

a second holding surface;

a first guide surface connecting the second holding surface to the first holding surface in the prescribed rotational direction; and a second guide surface connecting the first holding surface to the second holding surface in the prescribed rotational direction;

a switching mechanism configured to control the rotation of the cam;

a cam follower in contact with the cam surface, the cam follower being movable between:

an operating position for positioning the developing roller at the separated position; and a standby position for positioning the developing roller at the contact position, the cam follower in contact with the first holding surface being held at the standby position, the cam follower in contact with the second holding surface being held at the operating position, the first guide surface being configured to guide the cam follower to move from the first holding surface to the second holding surface in accordance with rotation of the cam in the prescribed rotational direction, the second guide surface being configured to guide the cam follower to move from the second holding surface to the first holding surface in accordance with the rotation of the cam in the prescribed rotational direction; and a controller configured to provide control to the switching mechanism to control the rotation of the cam, in a case where the developing roller is maintained at the contact position after being moved from the separated position, the controller being configured to control the switching mechanism to cause the cam:

to rotate to move the cam follower from the second holding surface to the first holding surface through the second guide surface; and to stop rotating to hold the cam follower in contact with the first guide surface and at a position closer to the first holding surface than to the second holding surface in the axial direction.

2. The image-forming apparatus according to claim 1, further comprising an urging member for urging the cam follower toward the standby position.

3. The image-forming apparatus according to claim 1, further comprising a phase sensor configured to detect a phase of the cam, the phase sensor being configured to be rendered ON to output a separation signal in a case where the cam is located within a predetermined phase range indicative of the developing roller being at the separated position, and the phase sensor being configured to be rendered OFF so as not to output the separation signal in a case where the cam is located outside of the predetermined phase range, wherein the controller is configured to:

rotate the cam for a prescribed period of time from a timing at which the separation signal from the phase sensor is no longer acquired; and subsequently stop the rotation of the cam to hold the cam follower in contact with the first guide surface and at a position closer to the first holding surface than to the second holding surface in the axial direction.

4. The image-forming apparatus according to claim 3, further comprising a sheet sensor positioned upstream of the photosensitive drum in a sheet conveying direction, the sheet sensor being configured to detect passage of a sheet therethrough, wherein the controller is further configured to:

rotate the cam prior to arrival of the sheet at the photosensitive drum after starting conveyance of the sheet;

stop the rotation of the cam at a temporary stop timing, the temporary stop timing being after elapse of a first period of time from a timing at which the separation signal from the phase sensor is switched from ON to OFF and the developing roller is in contact with the photosensitive drum;

resume the rotation of the cam at a restart timing, the restart timing being after elapse of a second period of time from a timing at which the sheet sensor detects passage of a leading end of the sheet; and stop the rotation of the cam at a stop timing after elapse of a third period of time from the restart timing to hold the cam follower in contact with the first guide surface and at a position closer to the first holding surface than to the second holding surface.

5. The image-forming apparatus according to claim 1, further comprising a developing cartridge including the developing roller, wherein the cam is rotatable about an axis in parallel to the axis of the developing roller, the cam comprising a first cam portion protruding toward the developing cartridge in the axial direction to provide the second holding surface; and wherein the cam follower in contact with the first cam portion is slidingly moved in the axial direction along the first cam portion to press the developing cartridge.

6. The image-forming apparatus according to claim 5, further comprising a support member configured to support the developing cartridge, wherein the developing cartridge comprises a slide member having a sloped surface sloping relative to the axial direction, the slide member being configured to be pressed by the cam follower to move in the axial direction in a state where the developing cartridge is supported by the support member, and wherein, in response to pressing by the cam follower in the axial direction, the sloped surface is configured to contact the support member to urge the developing cartridge in a direction perpendicular to the axial direction.

7. The image-forming apparatus according to claim 6, wherein the cam follower is separated away from the slide member in a state where the developing roller is at the contact position.

8. The image-forming apparatus according to claim 1, further comprising a motor configured to supply a driving force to the cam, wherein the switching mechanism is a clutch, and wherein the clutch is configured to transmit the driving force from the motor to the cam for rotating the cam, and to cut off transmission of the driving force from the motor to the cam for stopping rotation of the cam.

9. An image-forming apparatus comprising:

a photosensitive drum;

a developing roller rotatable about an axis extending in an axial direction and movable between a contact position in contact with the photosensitive drum and a separated position away from the photosensitive drum; and a developing roller moving mechanism comprising:

a rotatable cam rotatable in a prescribed rotational direction about a cam axis extending in the axial direction, the rotatable cam having a cam surface comprising:

a first holding surface;

a second holding surface;

a first guide surface connecting the second holding surface to the first holding surface in the prescribed rotational direction; and a second guide surface connecting the first holding surface to the second holding surface in the prescribed rotational direction; and a cam follower movable in the axial direction, wherein the rotatable cam is configured to move the cam follower between:

an operating position where the cam follower is in contact with the second holding surface and the developing roller is held at the separated position; and a standby position where the cam follower is in contact with the first holding surface and the developing roller is held at the contact position.

* * * * *